US008330445B2

(12) United States Patent
Herbst

(10) Patent No.: US 8,330,445 B2
(45) Date of Patent: Dec. 11, 2012

(54) CIRCUITS AND METHODS TO PRODUCE A VPTAT AND/OR A BANDGAP VOLTAGE WITH LOW-GLITCH PRECONDITIONING

(75) Inventor: Steven G. Herbst, San Francisco, CA (US)

(73) Assignee: Intersil Americas Inc., Milpitas, CA (US)

( * ) Notice: Subject to any disclaimer, the term of this patent is extended or adjusted under 35 U.S.C. 154(b) by 317 days.

(21) Appl. No.: 12/861,538

(22) Filed: Aug. 23, 2010

(65) Prior Publication Data

US 2011/0084681 A1 Apr. 14, 2011

Related U.S. Application Data

(60) Provisional application No. 61/249,948, filed on Oct. 8, 2009.

(51) Int. Cl.
*G05F 3/04* (2006.01)
*G05F 3/16* (2006.01)

(52) U.S. Cl. ..... 323/313; 323/907; 323/312; 323/314; 323/315; 323/316; 327/512; 327/513; 327/538; 327/539; 327/540

(58) Field of Classification Search ..... 323/907, 323/312, 313, 314, 315, 316; 327/512, 513, 327/538, 539, 540
See application file for complete search history.

(56) References Cited

U.S. PATENT DOCUMENTS 4,952,866 A 8/1990 Van Tujil
5,440,254 A 8/1995 Sundby
5,519,354 A 5/1996 Audy
5,619,122 A 4/1997 Kearney et al.
5,796,280 A 8/1998 Tuozzolo
5,982,221 A * 11/1999 Tuthill ..... 327/512
6,008,685 A 12/1999 Kunst
6,019,508 A 2/2000 Lien
6,037,832 A * 3/2000 Kaminishi ..... 327/538
6,157,244 A 12/2000 Lee et al.
6,288,664 B1 9/2001 Swanson
6,407,622 B1 6/2002 Opris
6,501,256 B1 12/2002 Jaussi et al.
(Continued)

OTHER PUBLICATIONS

K. Kujik, "A Precision Reference Voltage Source," IEEE J. Solid State Circuits, vol. SC-8, Jun. 1973, pp. 222-226.

(Continued)

*Primary Examiner* — Bao Q Vu
(74) *Attorney, Agent, or Firm* — Vierra Magen Marcus & DeNiro LLP

(57) ABSTRACT

Provided herein are circuits and methods to generate a voltage proportional to absolute temperature (VPTAT) and/or a bandgap voltage output (VGO) with low 1/f noise. A first base-emitter voltage branch is used to produce a first base-emitter voltage (VBE1). A second base-emitter voltage branch is used to produce a second base-emitter voltage (VBE2). The circuit also includes a first current preconditioning branch and/or a second current preconditioning branch. The VPTAT is produced based on VBE1 and VBE2. A CTAT branch can be used to generate a voltage complimentary to absolute temperature (VCTAT), which can be added to VPTAT to produce VGO. Which transistors are in the first base-emitter voltage branch, the second base-emitter voltage branch, the first current preconditioning branch, the second current preconditioning branch, and the CTAT branch changes over time. The current preconditioning branches are used to appropriately precondition transistors with an appropriate amount of current as they are switched into and out of the various other circuit branches.

20 Claims, 20 Drawing Sheets

U.S. PATENT DOCUMENTS

| | | | | |
|---|---|---|---|---|
| 6,507,179 | B1 | 1/2003 | Jun et al. | |
| 6,549,065 | B2 | 4/2003 | Opris | |
| 6,554,469 | B1 | 4/2003 | Thomson et al. | |
| 6,642,778 | B2 | 11/2003 | Opris | |
| 6,736,540 | B1 | 5/2004 | Sheehan et al. | |
| 6,890,097 | B2 | 5/2005 | Tanaka | |
| 6,914,475 | B2 * | 7/2005 | Enriquez et al. | 327/539 |
| 6,957,910 | B1 | 10/2005 | Wan et al. | |
| 7,083,328 | B2 | 8/2006 | Johnson | |
| 7,164,259 | B1 * | 1/2007 | Megaw et al. | 323/313 |
| 7,170,334 | B2 * | 1/2007 | Miranda et al. | 327/512 |
| 7,193,543 | B1 | 3/2007 | McLeod et al. | |
| 7,236,048 | B1 | 6/2007 | Holloway et al. | |
| 7,281,846 | B2 | 10/2007 | McLeod | |
| 7,309,157 | B1 | 12/2007 | Aslan et al. | |
| 7,312,648 | B2 * | 12/2007 | Yang | 327/512 |
| 7,321,225 | B2 * | 1/2008 | Garlapati et al. | 323/313 |
| 7,321,255 | B2 | 1/2008 | Maki | |
| 7,341,374 | B2 | 3/2008 | Chiu | |
| 7,368,973 | B2 | 5/2008 | Sato | |
| 7,420,359 | B1 | 9/2008 | Anderson et al. | |
| 7,579,860 | B2 | 8/2009 | Deken | |
| 7,724,075 | B2 | 5/2010 | Yang et al. | |
| 7,880,459 | B2 | 2/2011 | Harvey | |
| 8,022,751 | B2 * | 9/2011 | Le et al. | 327/539 |
| 2005/0001605 | A1 * | 1/2005 | Marinca | 323/314 |
| 2006/0255787 | A1 | 11/2006 | Schaffer et al. | |
| 2007/0152740 | A1 | 7/2007 | Georgescu et al. | |
| 2007/0252573 | A1 | 11/2007 | Tachibana et al. | |
| 2008/0095213 | A1 | 4/2008 | Lin et al. | |
| 2008/0278137 | A1 | 11/2008 | Harvey | |
| 2010/0002748 | A1 | 1/2010 | Lin et al. | |

OTHER PUBLICATIONS

B. Song, et al., "A Precision Curvature-compensated CMOS Bandgap Reference," IEEE J. Solid State Circuits, vol. SC-18, Dec. 1983, pp. 634-643.

M. Tuthill, "A Switched-current, Switched-capacitor Temperature Sensor in 0.6 um CMOS," IEEE J. Solid State Circuits, vol. SC-33, Jul. 1998, pp. 1117-1122.

M. Pertijs, et al., "A cmos Smart Temperature Sensor with a 3 Sigma Inaccuracy of +/-0.5 deg C from—50 to 120 deg C," IEEE J. Solid State Circuits, vol. SC-40, Feb. 2005, pp. 454-461.

M. Pertijs, et al., "A cmos Smart Temperature Sensor with a 3 sigma Inaccuracy of +/-0.1 deg C from—55 to 125 deg C," IEEE J. Solid State Circuits, vol. SC-40, Dec. 2005, pp. 2805-2815.

J. Huijsing, et al., "Analog Circuit Design", Boston/Dordrecht/London: Kluwer Academic, 1996,pp. 263, 350-351.

M. Pertijs, et al. "A High-Accuracy Temperature Sensor with Second-order Curvature Correction and Digital Bus Interface", in Proc. ISCAS, May 2001, pp. 368-371.

R. Pease, "The Design of Band-Gap reference Circuits: Trials and Tribulations," IEEE Proceedings of the 1990 Bipolar Circuits and Technology Meeting, Sep. 17-18, 1990.

P. Malcovati,et al., "Curvature-Compensated BiCMOS Bandgap with 1-V Supply Voltage," IEEE J. Solid state Circuits, vol. 36, No. 7 Jul. 2001, pp. 1076-1081.

Office Action for U.S. Appl. No. 12/718,840, dated Jun. 13, 2012.

Office Action for U.S. Appl. No. 12/718,840, dated May 30, 2012.

Office Action for U.S. Appl. No. 12/717,052, dated Feb. 21, 2012.

Office Action for U.S. Appl. No. 12/111,796, dated Jul. 14, 2010.

* cited by examiner

CIRCUITS AND METHODS TO PRODUCE A VPTAT AND/OR A BANDGAP VOLTAGE WITH LOW-GLITCH PRECONDITIONING

PRIORITY CLAIM

This application claims priority under 35 U.S.C. 119(e) to U.S. Provisional Patent Application No. 61/249,948, filed Oct. 8, 2009, entitled CIRCUITS AND METHODS TO PRODUCE A VPTAT AND/OR A BANDGAP VOLTAGE WITH LOW-GLITCH PRECONDITIONING, which is incorporated herein by reference.

RELATED APPLICATION

The present application relates to U.S. patent application Ser. No. 12/111,796, entitled "Circuits and Methods to Produce a VPTAT and/or a Bandgap Voltage" (Harvey), filed Apr. 29, 2008, which is incorporated herein by reference.

BACKGROUND

A voltage proportional to absolute temperature (VPTAT) can be used, e.g., in a temperature sensor as well as in a bandgap voltage reference circuit. A bandgap voltage reference circuit can be used, e.g., to provide a substantially constant reference voltage for a circuit that operates in an environment where the temperature fluctuates. A bandgap voltage reference circuit typically adds a voltage complimentary to absolute temperature (VCTAT) to a voltage proportional to absolute temperature (VPTAT) to produce a bandgap reference output voltage (VGO). The VCTAT is typically a simple diode voltage, also referred to as a base-to-emitter voltage drop, forward voltage drop, base-emitter voltage, or simply VBE. Such a diode voltage is typically provided by a diode connected transistor (i.e., a BJT transistor having its base and collector connected together). The VPTAT can be derived from one or more VBE, where ΔVBE (delta VBE) is the difference between the VBEs of BJT transistors having different emitter areas and/or currents, and thus, operating at different current densities. However, because BJT transistors age in a generally random manner, the VPTAT (as well as the VCTAT) will tend to drift over time, which will adversely affect a temperature sensor and/or a bandgap voltage reference circuit that relies on the accuracy of the VPTAT (and the accuracy of the VCTAT in the case of a bandgap voltage reference circuit). It is desirable to reduce such drift. Additionally, VPTAT and bandgap voltage reference circuits generate noise, a strong component of which is 1/f noise (sometimes referred to as flicker noise), which is related to the base current. It is desirable to reduce 1/f noise.

SUMMARY OF THE INVENTION

Provided herein are circuits and methods to generate a voltage proportional to absolute temperature (VPTAT) and/or a bandgap voltage output (VGO) with low 1/f noise. A circuit includes a group of X transistors. A first base-emitter voltage branch of the circuit is used to produce a first base-emitter voltage (VBE1) by providing a first amount of current to a current path (between a collector and an emitter) of each transistor in the first base-emitter voltage branch. A second base-emitter voltage branch of the circuit is used to produce a second base-emitter voltage (VBE2) by providing a second amount of current to a current path (between a collector and an emitter) of each transistor in the second base-emitter voltage branch. In some embodiments, N of the X transistors are connected to the second base-emitter voltage branch, such that their current is related by a factor of N to the current in the transistors connected in the first base-emitter voltage branch. The circuit can also include a first current preconditioning branch and/or a second current preconditioning branch. The first current preconditioning branch is configured to provide a current substantially equal to the first amount of current to each transistor within the first preconditioning branch. The second current preconditioning branch is configured to provide a current substantially equal to the second amount of current to each transistor within the second preconditioning branch. The VPTAT can be produced based on VBE1 and VBE2, e.g., by determining a difference between VBE1 and VBE2. A controller can control switches of the circuit to selectively change over time which of the X transistors are in the first base-emitter voltage branch, the second base-emitter voltage branch, the first current preconditioning branch and the second current pre-conditioning branch.

Additionally, a further circuit portion (e.g., a CTAT branch) can be used to generate a voltage complimentary to absolute temperature (VCTAT) using at least one of the X transistors. The VPTAT and the VCTAT can be used, e.g., added, to produce a bandgap reference output voltage (VGO). The controller can also control switches to change over time which transistor(s) is/are used to produce VCTAT. Further, the transistor(s) that is/are switched into and out of the CTAT branch can be appropriately preconditioned using the first and/or second current preconditioning branches.

If switches were used to cause a transistor to move from being within the first base-emitter voltage branch (or the "CTAT" branch) to immediately being within the second base-emitter voltage branch, the current provided to the current path of that transistor would immediately decrease (e.g., by a factor of N), which can result in glitches that adversely affect that accuracy of VPTAT and/or VGO. Further, if switches were used to cause a transistor to change from being within the second base-emitter voltage branch to immediately being within the first base-emitter voltage branch (or the "CTAT" branch), the current provided to the current path of that transistor would immediately increase (e.g., by the factor of N), which can also result in glitches that adversely affect that accuracy of VPTAT and/or VGO. To significantly reduce such glitches, and the effects of such glitches, the current preconditioning branches are used to precondition a transistor being switched out of one branch and into another branch where the current provided to the current path of that transistor will increase or decrease (e.g., by the factor of N).

Further and alternative embodiments, and the features, aspects, and advantages of the embodiments of invention will become more apparent from the detailed description set forth below, the drawings and the claims.

DETAILED DESCRIPTION

Figure 1:
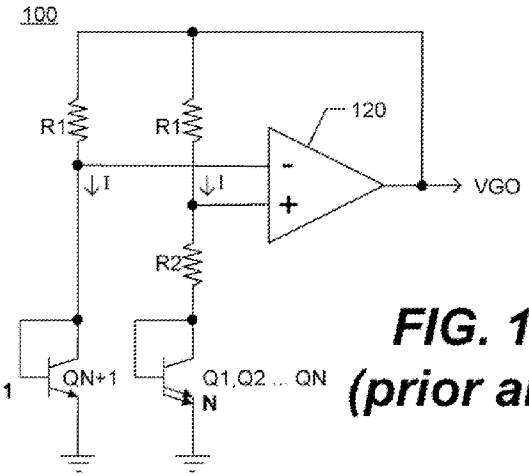
FIG. 1 (prior art)
FIG. 1 illustrates an exemplary conventional bandgap voltage reference circuit.

FIG. 1 illustrates an exemplary conventional bandgap voltage reference circuit 100 that includes N+1 transistors, including diode connected transistors Q1 through QN connected in parallel in one branch of the circuit (which can be referred to as the "N" branch, since it includes N transistors), a further diode connected transistor QN+1, a differential input amplifier 120 (e.g., an operational amplifier), a pair of resistors R1, and a resistor R2. In this arrangement, the transistor QN+1 is used to generate a VCTAT, and transistors Q1 through QN in conjunction with transistor QN+1 are used to generate the VPTAT. In this embodiment, the QN+1 can be considered to be in both a "1" branch and a "CTAT" branch, which terms are explained in more detail with reference to FIG. 3. More specifically, the VCTAT is a function of the base emitter voltage (VBE) of transistor QN+1, and the VPTAT is a function of ΔVBE, which is a function of the difference between the base-emitter voltage of transistor QN+1 and the base-emitter voltage of parallel connected transistors Q1 through QN. Here, the bandgap voltage output (VGO) is as follows: VGO=VBE+(R1/R2)*Vt*ln(N). If VBE~0.7V, and (R1/R2)*Vt*ln(N)~0.5V, then VGO~1.2V. In the arrangement of FIG. 1, because transistor QN+1 will age differently than at least some of transistors Q1 through QN, the bandgap voltage output (VGO) will drift over time, which is undesirable.

Figure 2A:
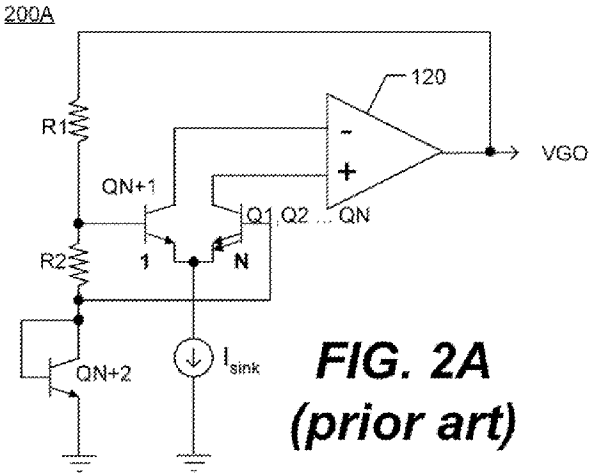
FIG. 2A (prior art)
FIG. 2A illustrates an alternative exemplary conventional bandgap voltage reference circuit.

FIG. 2A illustrates an alternative exemplary conventional bandgap voltage reference circuit 200A, including transistors Q1 through QN connected in parallel (in the "N" branch), a further transistor QN+1 (in the "1" branch), a differential input amplifier 120, a resistor R1, a resistor R2, a diode connected transistor QN+2 (in the "CTAT" branch), and a current sink I. In this arrangement, the transistor QN+2 is used to generate a VCTAT, and transistors Q1 through QN+1 are used to generate a VPTAT. In this arrangement, if the transistor QN+2 ages differently than at least some of the transistors Q1 through QN+1, then the VCTAT will drift relative to the VPTAT, causing an undesirable drift in the VGO. Also, if transistor QN+1 ages differently than at least some of transistors Q1 through QN, then the VPTAT will drift, causing an undesirable drift in the VGO.

Figure 2B:
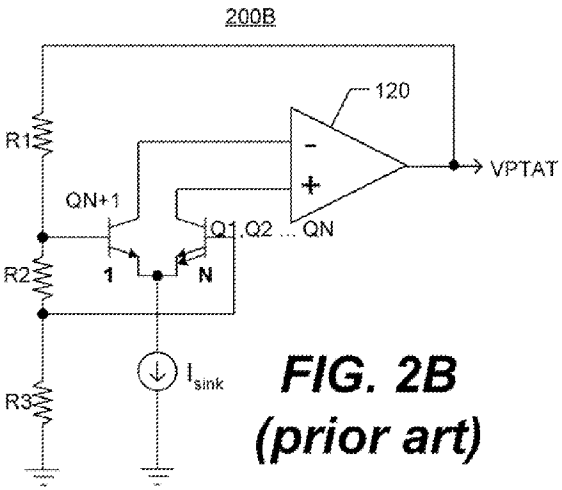
FIG. 2B (prior art)
FIG. 2B illustrates an exemplary circuit for generating a voltage proportional to absolute temperature (VPTAT).

FIG. 2B illustrates an exemplary conventional circuit 200B for generating a VPTAT, including transistors Q1 through QN connected in parallel (in the "N" branch), a further transistor QN+1 (in the "1" branch), a differential input amplifier 120, resistors R1, R2 and R3, and a current sink I. In this arrangement, if the transistor QN+1 ages differently than at least some of the transistors Q1 through QN, then an undesirable drift in the VPTAT will occur. A comparison between FIGS. 2B and FIG. 2A shows that FIG. 2B is the same as FIG. 2A, except that transistor QN+2 is replaced with the resistor R3 in FIG. 2B. Since a VCTAT is not generated in FIG. 2B, there is no "CTAT" branch.

In FIG. 1, the output of the differential input amplifier 120, which is connected to the upper terminal of the resistor R1, is adjusted through a feedback loop until the non-inverting (+) and inverting (−) inputs of the amplifier 120 are equal. This sets the voltage across the two R1 resistors to be equal, which establishes equal currents in both branches, establishing a ΔVBE as described above. In FIGS. 2A and 2B, the action of the amplifier 120 is to establish the collectors of the "N" and "1" transistors at the same voltage potential. This causes the current Isink to split evenly between the "N" and "1" branches. A ΔVBE is thus established across the resistor R2, causing a current ΔVBE/R2 to flow through the resistor R1. In the case of FIG. 2A, this sets VGO=VCTAT+ΔVBE+R1/R2*ΔVBE=VCTAT+ΔVBE*(1+R1/R2). Note that ΔVBE is a PTAT voltage. Similarly, in FIG. 2B, VPTAT=ΔVBE*(1+(R1+R3)/R2).

Figure 3:
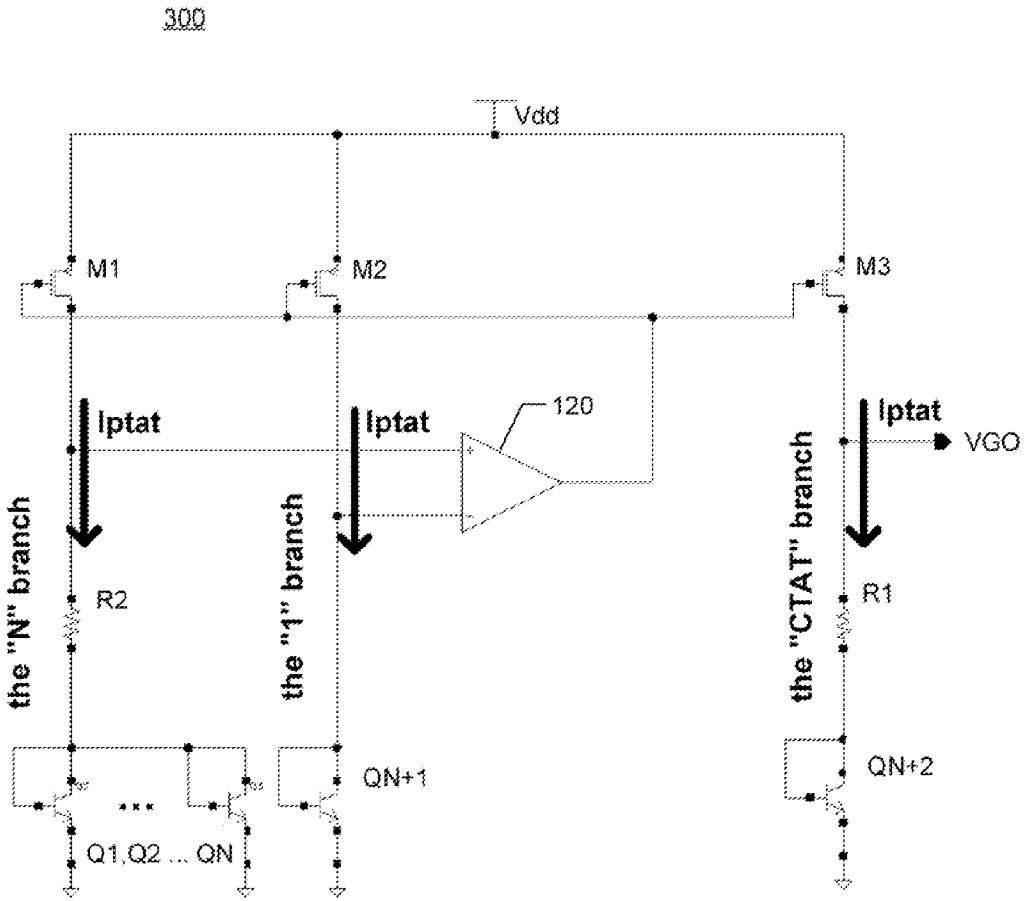
FIG. 3 (prior art)
FIG. 3 illustrates another exemplary conventional bandgap voltage reference circuit.

FIG. 3 illustrates another exemplary conventional bandgap voltage reference circuit 300, including transistors Q1 through QN connected in parallel (in the "N" branch), a transistor QN+1 (in the "1" branch), and a further transistor QN+2 (in the "CTAT" branch). In this arrangement, the transistor QN+2 is used to generate a VCTAT, and transistors Q1 through QN in conjunction with transistor QN+1 are used to generate the VPTAT. More specifically, the VCTAT is a function of the base emitter voltage (VBE) of transistor QN+2, and the VPTAT is a function of ΔVBE, which is a function of the difference between the base-emitter voltage of transistor QN+1 and the base-emitter voltage of parallel connected transistors Q1 through QN.

In FIG. 1, the amplifier 120 supplies current to the "N" and "1" branches. As a result, the amplifier topology should have a buffered output stage. This tends to introduce amplifier offset, and by consequence, increases the offset seen at the bandgap output (VGO). It is possible, however, to eliminate the need for a buffer. The amplifier 120 can instead be used to control the gates of PMOS transistors, which have very high input resistance, drawing almost no DC current from the amplifier 120. As illustrated in FIG. 3, it is these PMOS transistors, not the amplifier 120, that supply current in the "N", "1", and "CTAT" branches. Since the gates of the PMOS transistors are tied together, and their source terminals are all connected to the positive voltage rail, the source-to-gate voltages of these transistors are equal. As a result, the "N", "1", and "CTAT" branches operate at the same current, Iptat. Due to negative feedback, the amplifier 120 adjusts the common PMOS gate voltage until the non-inverting (+) and inverter (−) terminals of the amplifier 120 are at equal voltage potentials. This occurs when Iptat*R2+(VBE−ΔVBE)=VBE, where VBE corresponds to the base-to-emitter voltage of a single NPN transistor. Thus, Iptat=ΔVBE/R2.

Here, the bandgap voltage output (VGO) is as follows: VGO=VBE+R1/R2*Vt*ln(N). If VBE~0.7V, and R1/R2*Vt*ln(N)~0.5V, then VGO~1.2V. In the arrangement of FIG. 3, because transistor QN+1 and QN+2 will age differently than one another and then at least some of transistors Q1 through QN, the bandgap voltage output (VGO) will drift over time, which is undesirable.

FIGS. 1-3 are used to illustrate deficiencies of some exemplary conventional bandgap voltage reference circuits and VPTAT circuits. Such deficiencies, as explained above, are caused by the various transistors of the circuits aging differently, which can cause VPTAT, VCTAT and/or VGO to undesirably drift over time. FIGS. 4A-9B below, which were introduced in the related commonly assigned U.S. patent application Ser. No. 12/111,796, entitled "Circuits and Methods to Produce a VPTAT and/or a Bandgap Voltage," illustrate various ways deficiencies of the above described circuits can be overcome. The same deficiency exists in other bandgap voltage reference circuits and VPTAT circuits. Accordingly, while many of the FIGS. discussed below are used to explain how the deficiencies of the above described circuits can be overcome, one of ordinary skill in the art would appreciate from the description herein how the concepts of embodiments described below can be applied to alternative bandgap voltage reference circuits and alternative VPTAT circuits.

Figure 4A:
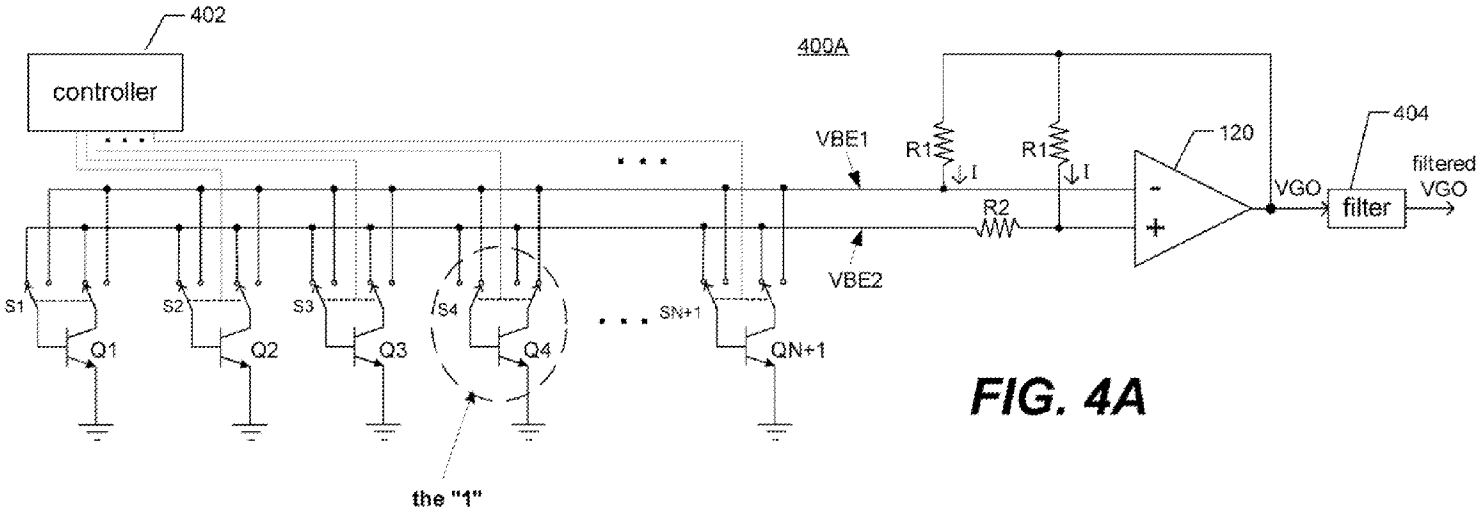
FIGS. 4A, 4B, 5A and 5B illustrates various bandgap voltage reference circuits that overcome some of the deficiencies of the circuits of FIGS. 1 and 2A.

FIG. 4A illustrates a bandgap voltage reference circuit 400A, which is a modification of the circuit 100 discussed above with reference to FIG. 1. The bandgap voltage reference circuit 400A includes N+1 transistors (i.e., transistors Q1 through QN+1), a differential input amplifier 120, a pair of resistors R1, and a resistor R2. The bandgap voltage reference circuit 400A also includes switches S1 through SN+1, which are each shown as double-pole-double-throw switches. In place of the double-pole-double-throw switches, a pair of single-pole-single-throw switches can be used, but such a pair will still be referred to as a switch. The switches can be implemented, e.g., using CMOS transistors.

A comparison of FIG. 4A to FIG. 1 shows that transistor Q4 in FIG. 4A is connected by switch S4 such that it is connected in the same manner that transistor QN+1 is shown as being connected in FIG. 1; and the remaining transistors in FIG. 4A are connected by their respective switches in the same manner that transistors Q1 through QN are shown as being connected in FIG. 1. In other words, in FIG. 4A, the transistor Q4 is connected as the "1" individual diode connected transistor (in the "1" branch and the "CTAT" branch), and the remaining N transistors are connected as diode connected parallel transistors (in the "N" branch).

In an embodiment the switches are controlled by a controller 402 such that the "1" transistor connected as the individual diode connected transistor changes over time (e.g., in a cyclical or random manner), which also means that the multiple diode connected parallel transistors change over time (e.g., in a cyclical or random manner). Stated another way, 1 of the N+1 transistors is used to produce a first base-emitter voltage (VBE1), and N of the N+1 transistors are used to produce a second base-emitter voltage (VBE2). A difference between VBE1 and VBE2 is used to produce a VPTAT. In FIG. 4A, VBE1 is also used to produce a VCTAT. Which of the transistors are used to produce VBE1, and thus, the VPTAT, and the VCTAT, changes over time (e.g., in a cyclical or random manner). This way, if the VGO is averaged, e.g., using a filter 404, then the effect of any individual transistors aging is averaged out, reducing the drift of the filtered VGO. Stated still another way, which of the transistors are in the "1", "CTAT" and "N" branches changes over time.

In an embodiment, during N+1 periods of time, each of the N+1 transistors can be selected to be used to produce the VBE1, as well as to be used to produce the VBE2. However, this is not necessary. In an embodiment the controller 402 controls the switches to produce a predictably shaped switching noise that can be filtered by the filter 404, or a further filter. This can include purposely not using certain transistors to produce VBE1 and/or not using certain transistors to produce VBE2, and/or not using certain transistors to produce VCTAT. The controller 402 can be implemented by a simple counter, a state machine, a micro-controller, a processor, but is not limited thereto. In certain embodiments, the controller 402 can randomly select which transistor(s) is/are used to produce VBE1 and/or which transistor(s) is/are used to produce VCTAT, e.g., using a random or pseudo-random number generator which can be implemented as part of the controller, or which the controller can access. Even where there is a random or pseudo-random sequencing of transistors, certain transistors can be purposefully not used to produce VBE1, VBE2 and/or VCTAT. Where the controller 402 cycles through which transistor(s) is/are used to produce VBE1 and/or which transistor(s) is/are used to produce VCTAT, the cycling can always be in the same order, or the order can change. Also, during the cycling certain transistors can be purposefully not used to produce VBE1, VBE2 and/or VCTAT. In other words, certain transistors can be purposefully not used in one or more branches of the circuit.

In the embodiments of FIG. 4A, each transistor is always diode connected. Accordingly, each diode can be fixedly diode connected and the double-pole-double-throw switches S1 through SN+1 of FIG. 4A (or alternative the pairs of single-pole-single-throw switches), can be replaced with single-pole-single-throw switches, as shown in the bandgap voltage reference circuit 400B of FIG. 4B. In this, and other embodiments described herein, when the switches are used to selectively change a circuit configuration, the switches are preferably controlled in a make-before-break manner (i.e., a new contact is made before an old contact is broken) so that a moving contact never sees an open circuit, thereby preventing VPTAT (and/or VCTAT and/or VGO) from rapidly swinging.

Figure 4B:
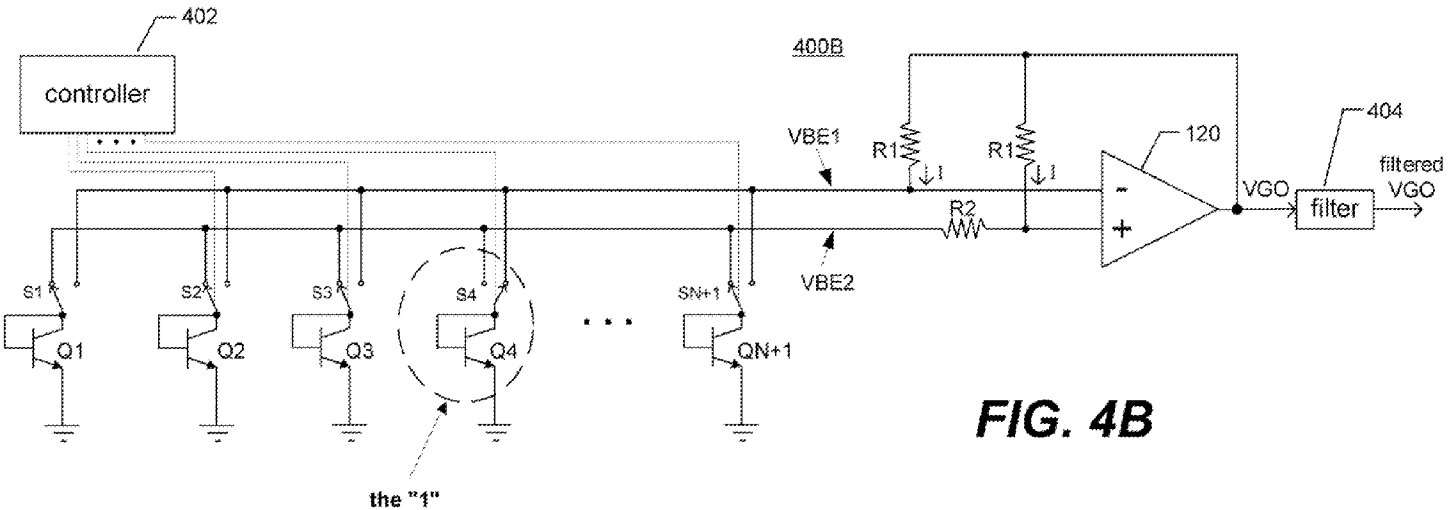

In the embodiments of FIGS. 4A and 4B, assume the desire is to use a ratio of N to 1 transistors (e.g., N=8) when producing VBE1 and VBE2. This can alternatively be accomplished using 2*(N+1) transistors, connecting two transistors at a time like transistor Q4 in FIGS. 4A and 4B, and connecting the remaining 2*N transistors like transistor Q1 in FIGS. 4A and 4B. Thus, more generally, assuming X transistors are used to generate VBE1 and VBE2, a first subgroup of Y of the X transistors can be used to produce the first base-emitter voltage (VBE1), and a second subgroup of Z of the X transistors can be used to produce the second base-emitter voltage (VBE2), where $1 \leqq Y < Z < X$.

Figure 5A:
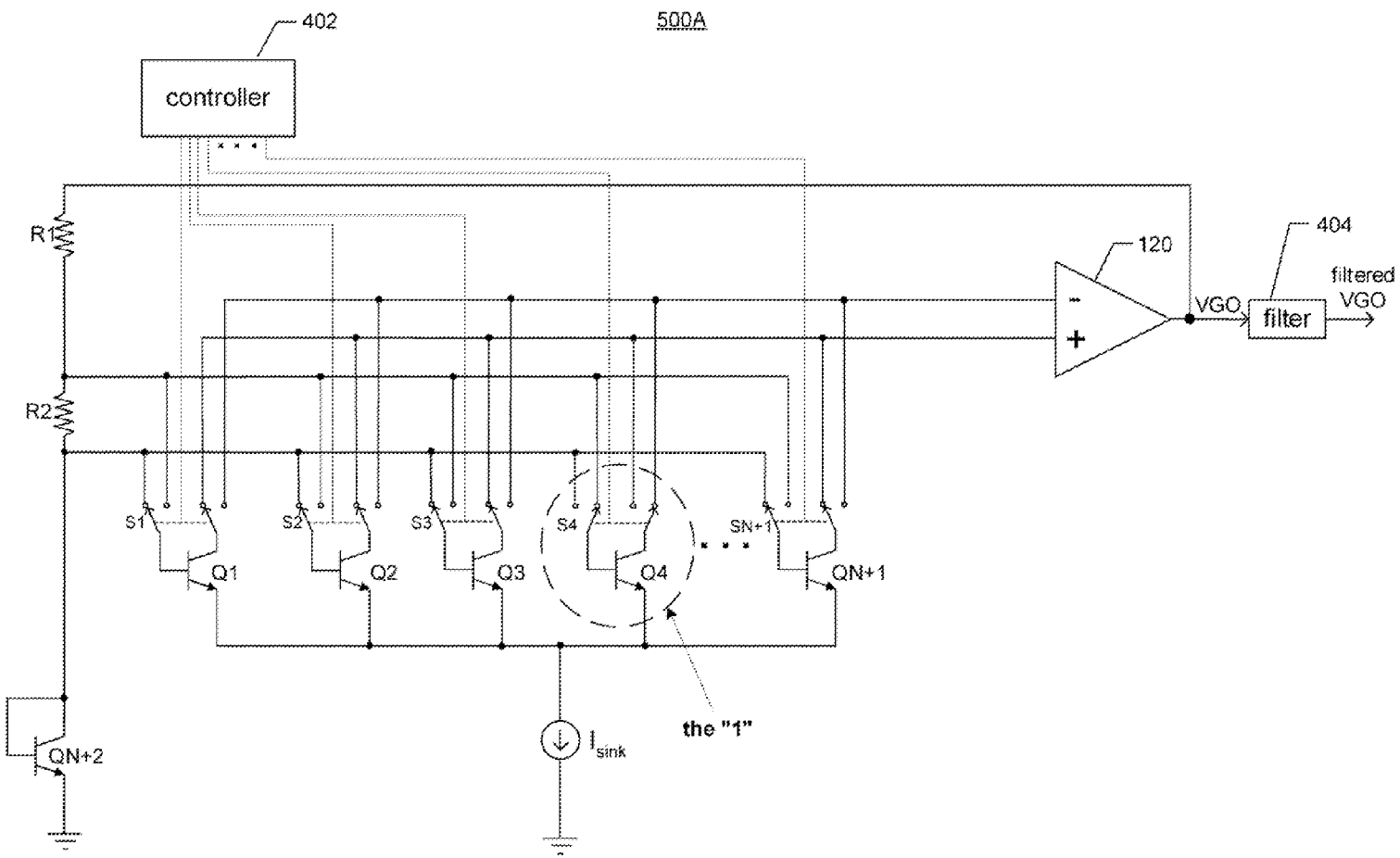

FIG. 5A illustrates a bandgap voltage reference circuit 500A, which is a modification of the circuit 200A discussed above with reference to FIG. 2A. The bandgap voltage reference circuit 500A includes N+2 transistors (i.e., transistors Q1 through QN+2), a differential input amplifier 120, a resistor R1, a resistor R2, and current sink I. The bandgap voltage reference circuit 500A also includes switches S1 through SN+1, which are each shown as double-pole-double-throw switches. In place of the double-pole-double-throw switches, a pair of single-pole-single-throw switches can be used, but the pair will still be referred to as a switch.

A comparison of FIG. 5A to FIG. 2A shows that transistor QN+2 is connected the same in both FIGS., transistor Q4 in FIG. 5A is connected by switch S4 such that it is connected in the same manner that transistor QN+1 is connected in FIG. 2A, and the remaining transistors in FIG. 5A are connected by their respective switches in the same manner that transistors Q1 through QN are connected in FIG. 2A. Here, 1 of the N+2 transistors is used to produce a first base-emitter voltage (VBE1), N of the N+2 transistors are used to produce a second base-emitter voltage (VBE2), and a difference between VBE1 and VBE2 is used to produce a VPTAT. In FIG. 5A, one of the N+2 transistors (i.e., transistor QN+2) is always used to produce the VCTAT. Which of the transistors are used to produce VBE1 and VBE2 changes over time (e.g., in a cyclical or random manner). This way, if the VGO is averaged, e.g., using the filter 404, then the effect of any individual transistors aging on the VPTAT is averaged out, reducing the drift of the filtered VGO. Stated another way, in FIG. 5A, which of the transistors are in the "1" and "N" branches changes over time, but the transistor QN+2 in the "CTAT" branch does not change.

In accordance with an embodiment, during N+1 periods of time, each of the N+1 transistors is selected to be used to produce the VBE1, as well as to be used to produce the VBE2. However, this is not necessary. In accordance with an embodiment, the controller 402 controls the switches to produce a predictably shaped switching noise that can be filtered by the filter 404, or a further filter. This can include purposely not using certain transistors to produce VBE1 and/or not using certain transistors to produce VBE2. Additional details of the controller 402 are discussed above. Where the controller 402 cycles through which transistor(s) is/are used to produce VBE1 and/or VBE2, the cycling can always be in the same order, or the order can change. Also, during the cycling certain transistors can be purposefully not used to produce VBE1 and/or VBE2.

Figure 5B:
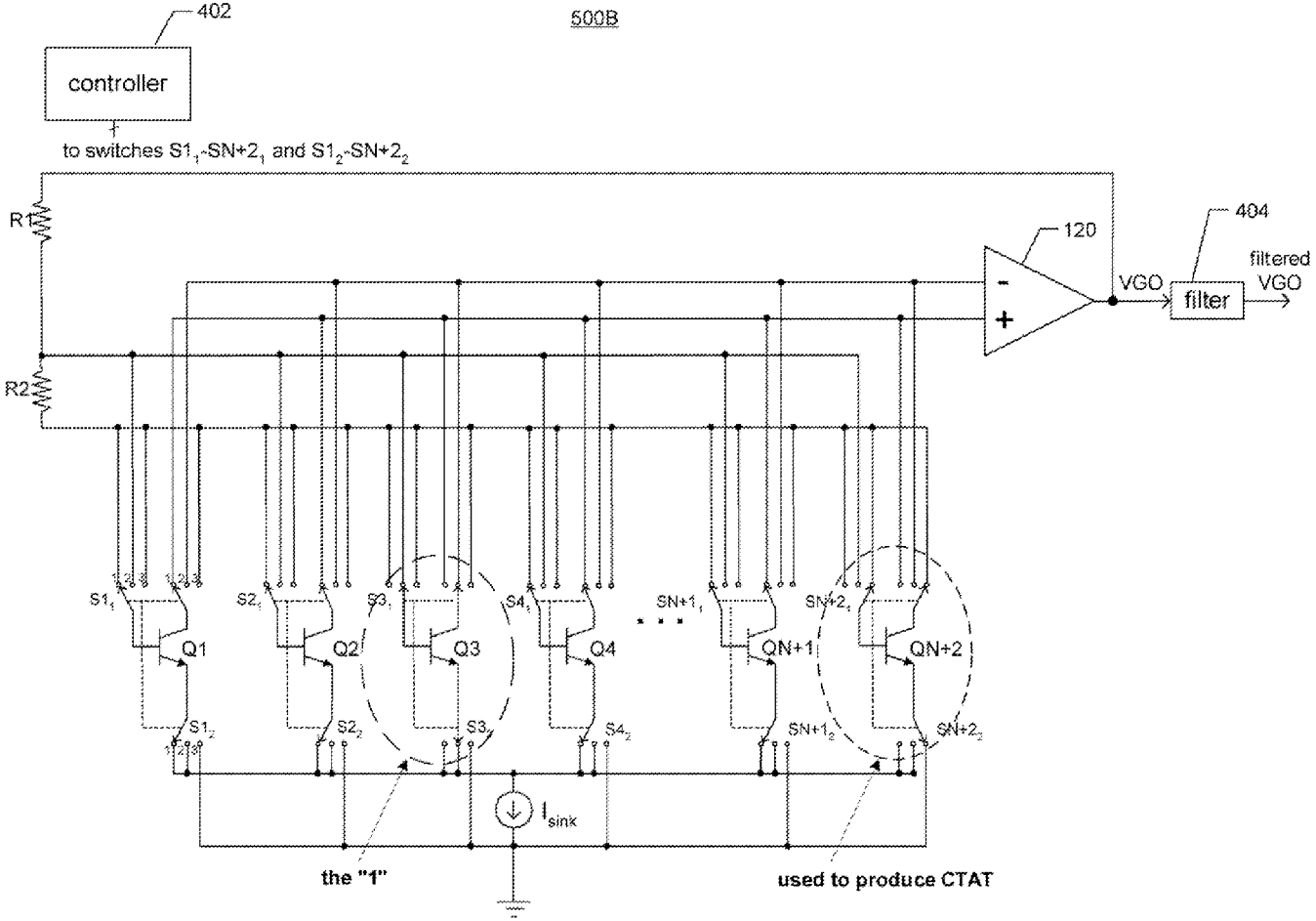

In the bandgap reference voltage circuit 500A of FIG. 5A, the effect of aging of transistor QN+2 is not reduced. Accordingly, the bandgap reference voltage circuit 500B of FIG. 5B is provided, in which FIG. the transistors in the "1", the "N" and the "CTAT" branches change over time. As can be seen in FIG. 5B, the transistor that is used to produce the VCTAT is also changed over time (e.g., in a cyclical or random manner). Here, 1 of the N+2 transistors is used to produce a first base-emitter voltage (VBE1), N of the N+2 transistors are used to produce a second base-emitter voltage (VBE2), and a difference between VBE1 and VBE2 is used to produce a VPTAT. Also, in the bandgap reference voltage circuit 500B of FIG. 5B, 1 of the N+2 transistors is used to produce the VCTAT. In FIG. 5B, the bandgap reference voltage circuit 500B switches $S1_1$ through $SN+2_1$ and switches $S1_2$ through $SN+2_2$ can be, e.g., double-pole-triple-throw switches, or pairs of single-pole-triple-throw switches.

In accordance with an embodiment, during N+2 periods of time, each of the N+2 transistors is selected to be used to produce the VBE1, as well as to be used to produce the VBE2, as well as to produce the VCTAT. However, this is not necessary. In accordance with an embodiment, the controller 402 controls the switches to produce a predictably shaped switching noise that can be filtered by the filter 404. This can include purposely not using certain transistors to produce VBE1 and/or not using certain transistors to produce VBE2, and/or not using certain transistors to produce the VCTAT. Additional details of the controller 402 are discussed above. Where the controller 402 cycles through which transistor(s) is/are used to produce VBE1 and/or VBE2 and/or which transistor(s) is/are used to produce VCTAT, the cycling can always be in the same order, or the order can change. Also, during the cycling certain transistors can be purposefully not used to produce VBE1, VBE2 and/or VCTAT.

In the embodiments of FIGS. 5A and 5B, assume the desire is to use a ratio of N to 1 transistors (e.g., N=8) when producing VBE1 and VBE2. This can alternatively be accomplished using 2*(N+1) transistors, connecting 2 transistors at a time like transistor Q4 in FIGS. 5A and 5B, and connecting 2*N transistors like transistor Q1 in FIGS. 5A and 5B. Thus, more generally, assuming X transistors are used to generate VBE1 and VBE2, a first subgroup of Y of the X transistors can be used to produce the first base-emitter voltage (VBE1), a second subgroup of Z of the X transistors can be used to produce the second base-emitter voltage (VBE2), where $1 \leqq Y < Z < X$. Further, at least one of the X transistors can be used to produce the VCTAT. The transistor that is used to produce the VCTAT can stay the same, as in FIG. 5A, or change, as in FIG. 5B.

Figure 6:
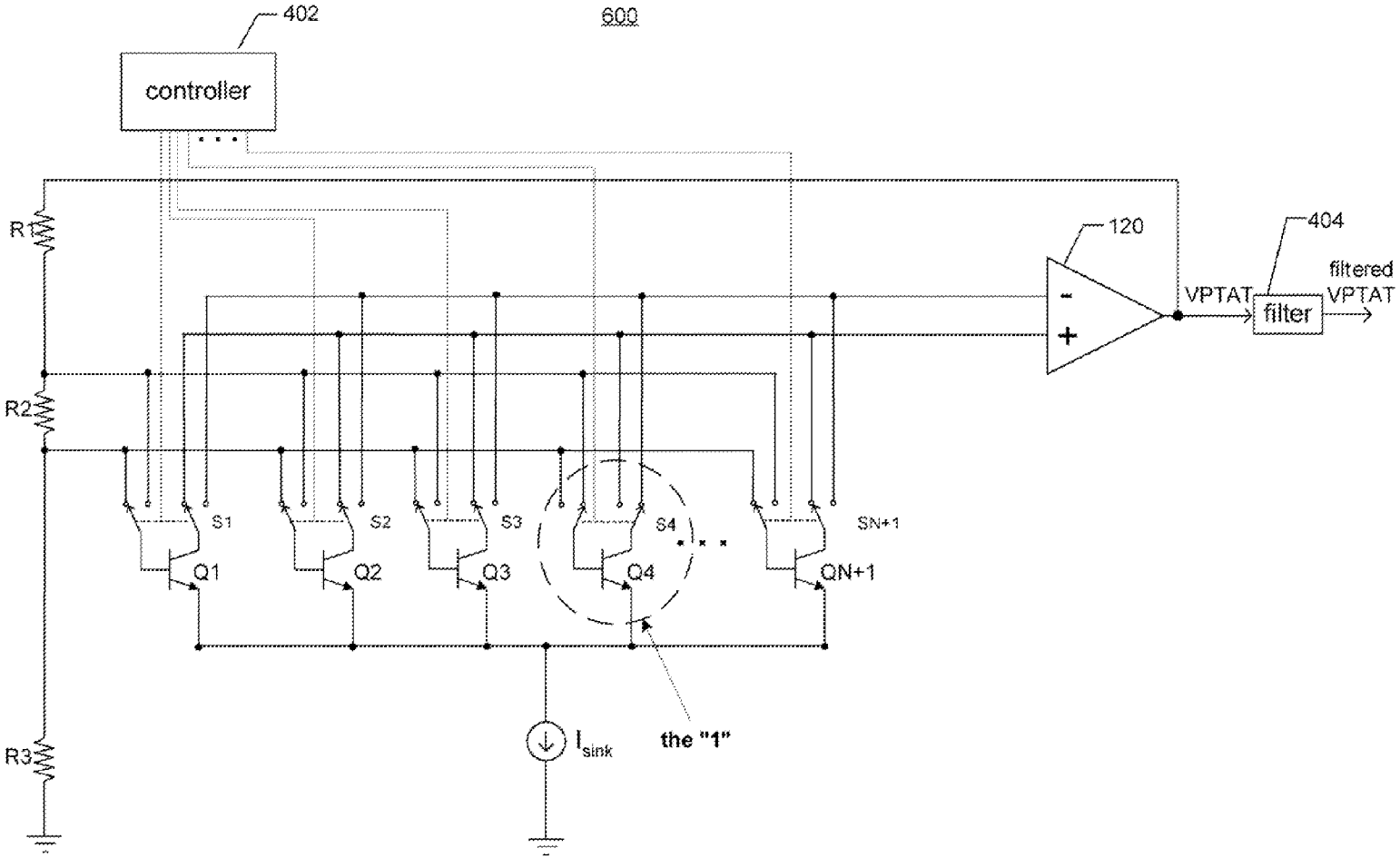
FIG. 6 illustrates a circuit for generating a voltage proportional to absolute temperature (VPTAT) that overcomes some of the deficiencies of the circuit of FIG. 2B.

FIG. 6 illustrates a VPTAT circuit 600, which is a modification of the circuit 200B discussed above with reference to FIG. 2B. The VPTAT circuit 600 of FIG. 6 functions in the same manner as the bandgap voltage reference circuit 500A of FIG. 5A, except that transistor QN+1 is replaced with resistor R3. In FIG. 6, the transistors in the "1" and the "N" branches change over time.

Figure 7:
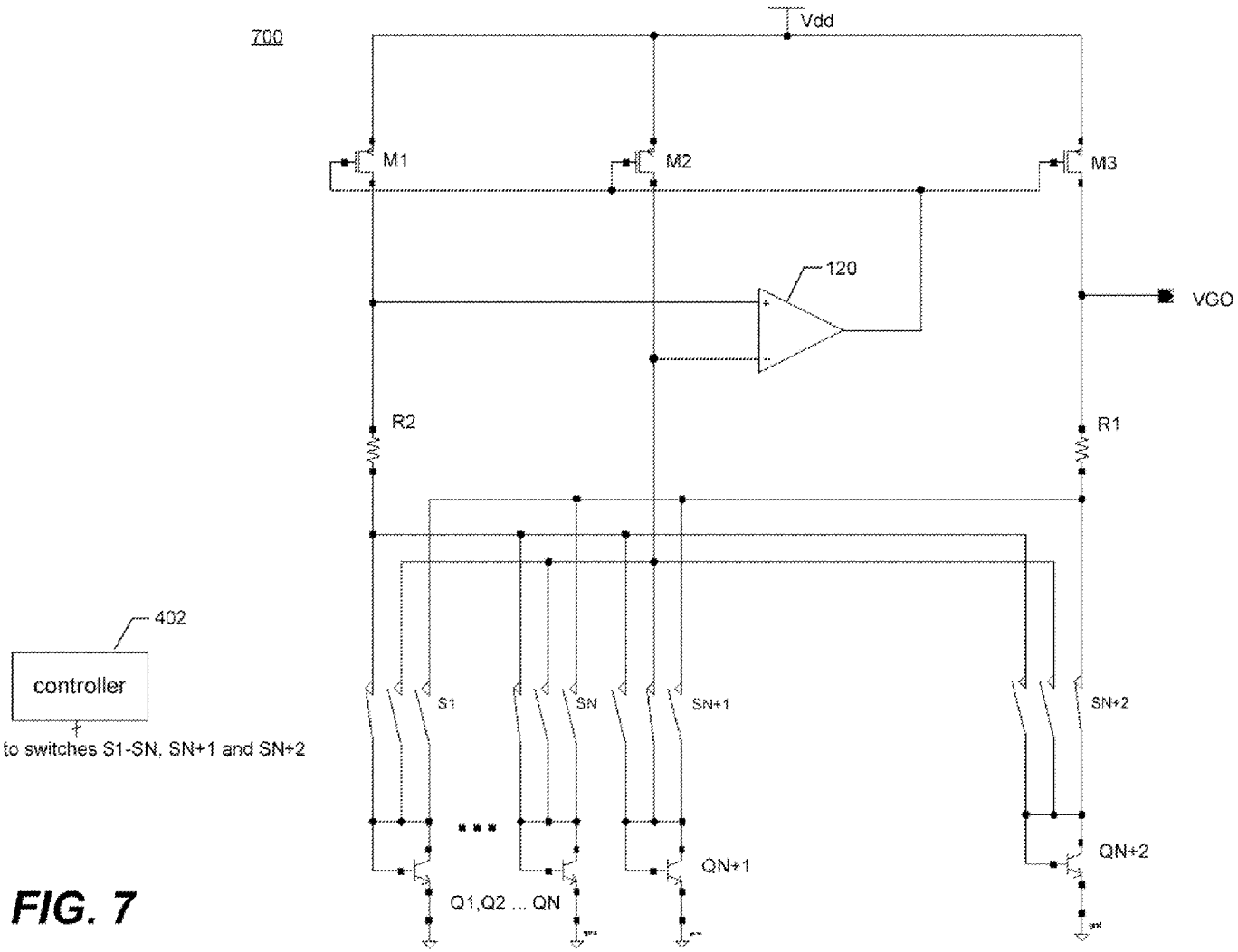
FIG. 7 illustrates a bandgap voltage reference circuit that overcomes some of the deficiencies of the circuit of FIG. 3.
Figure 8A:
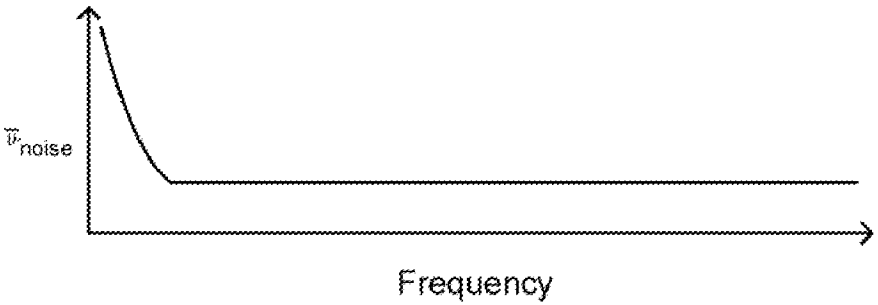
FIG. 8A illustrates exemplary 1/F noise of a conventional bandgap reference voltage or VPTAT circuit.
Figure 8B:
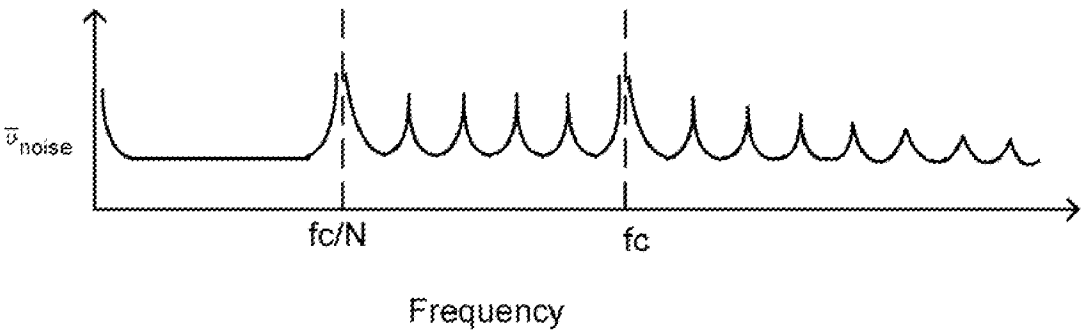
FIG. 8B illustrates how embodiments of FIGS. 4A-7 can be used to spread the 1/F noise and thereby reduce its peak spectral content.

FIG. 7 illustrates a bandgap voltage reference circuit 700, which is a modification of the circuit 300 discussed above with reference to FIG. 3. More specifically, FIG. 7 illustrates how the bandgap voltage reference circuit 300 shown in FIG. 3 can also be modified to include switches and a controller so that the transistors that are used to produce VBE1 and VBE2, and preferably also VCTAT, are changed over time. In FIG. 7, the transistors that are in the "1", the "N" and the "CTAT" branches change over time.

In the embodiments described herein, the transistor(s) that is/are used to produce the first base-emitter voltage (VBE1) can also be referred to as being within the first base-emitter voltage branch, and the transistors that are used to produce the second base-emitter voltage (VBE2) can be referred to as being within the second base-emitter voltage branch. Similarly, the transistor(s) that is/are used to produce the VCTAT can be referred to as being within the CTAT branch.

In the embodiments described above, a pool of bipolar junction transistors (BJTs) are provided, and one (or possibly more) of which is/are used as a ΔVBE reference to the rest of the pool. Assume a pool of N BJTs. If one BJT device (shown as "the 1" in the FIGS.) is selected to act as a ΔVBE reference against the other N−1 devices, the solo device will have a 1/f contribution, and each of the rest of the devices will each have a 1/(N−1) contribution. Since there are N−1 devices in the pool with individual 1/f noises to root mean square (RMS), we get a noise contribution of the pool as one transistor's noise divided by $\sqrt{N-1}$. The operating current will be lower compared to the solo transistor by (N−1) as well, further reducing 1/f content. Thus, the solo transistor has dominant noise, the pool's noise averaged down. By cycling one (or more) transistor out of the pool as the solo transistor at a rate much faster than 1/f, then the 1/f contribution is modulated upward in frequency. If the cycle frequency is fc, then the 1/f spectrum is promoted in frequency as shown in FIG. 7. The 1/f content of the BJTs will be reduced in RMS by $\sqrt{N}$, since N devices' noise RMS, but with a duty cycle each of 1/N. The now high-frequency 1/f noise can be filtered out, e.g., by filter 404. The cycling can be digitally controlled (e.g., randomized) to limit the peak spectral content. Now the 1/f noise is transformed so it resembles FIG. 8. This has less peak spectral content, but spreads noise down to fc/N. Note that the 1/f noise is diminished in FIG. 8, but not gone. The 1/f modulates the switching spectral peaks. For a clock of fc, there will be a lowest tone of fc/N, where there are N devices to be switched repetitively. There will be N spectral components from fc/N to not quite fc (only a few are shown). There will be harmonics of all fc/N to not quite fc components.

Stated another way, "the 1" transistor will have a 1/f noise content proportional to its operating current density. A transistor is cycled (or otherwise selected to be) in and out of "the 1" location rapidly compared to 1/f frequencies. Assuming each of the N transistors is in "the 1" position only 1/N of the time (which need not be the case), when the VGO or VPTAT signal is averaged or filtered, each transistor contributes only 1/N of its 1/f voltage. However, there are N transistors each with an independent noise to be added in turn to "the 1" position. Thus, "the 1" transistor ends up contributing $\sqrt{N}/N$ or $1/\sqrt{N}$ of the its 1/f noise. The rest of the N transistors' 1/f energy is promoted to higher spectrum by the cyclic modulation process. The other N−1 transistors contribute the same noise as do the N−1 transistors of a conventional stationary bandgap, although this is smaller than the 1/f noise of "the 1" transistor due to smaller current density.

Figure 9A:
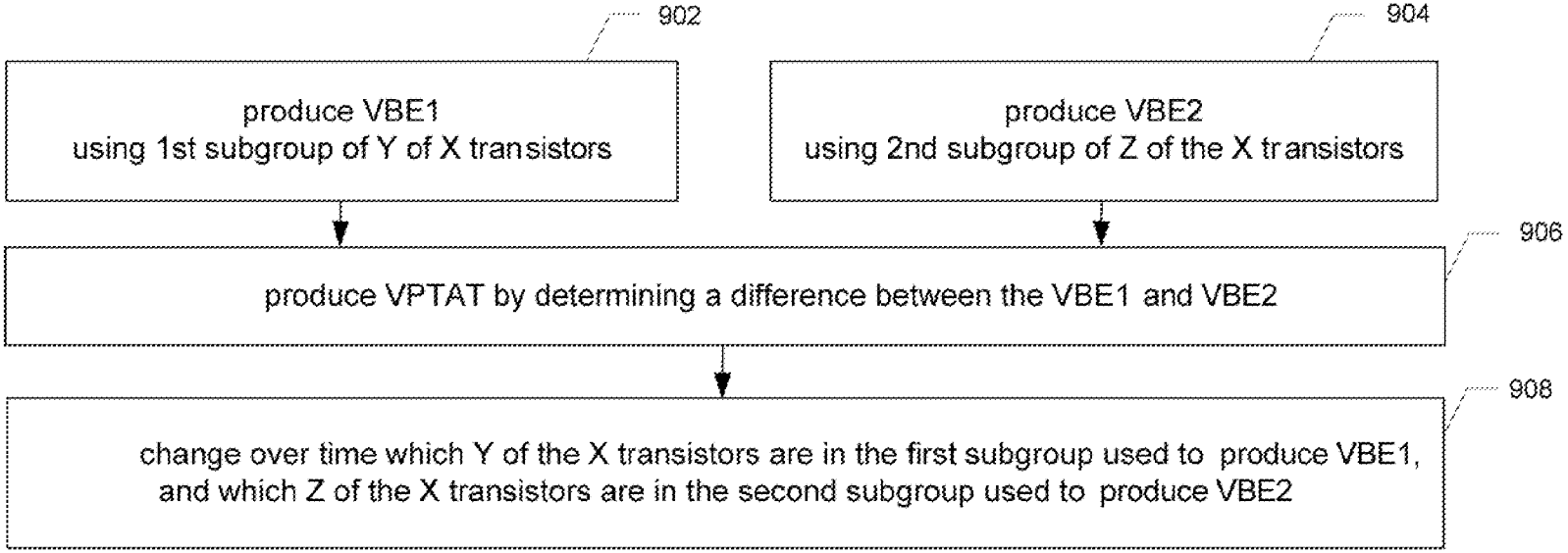
FIG. 9A is a high level flow diagram used to summarize various embodiments for producing a VPTAT.

FIG. 9A is a high level flow diagram that is used to summarize the above described techniques for producing a VPTAT using a group of X transistors. At step 902, a first base-emitter voltage (VBE1) is produced using a first subgroup of Y of the X transistors, where $1 \leqq Y < X$. At step 904, a second base-emitter voltage (VBE2) is produced using a second subgroup of Z of the X transistors, where $Y < Z < X$. At step 906, the VPTAT is produced by determining a difference between the first base-emitter voltage (VBE1) and the second base-emitter voltage (VBE2). At step 908, which Y of the X transistors are in the first subgroup that are used to produce the first base-emitter voltage (VBE1), and which Z of the X transistors are in the second subgroup that are used to produce the second base-emitter voltage (VBE2), are changed over time (e.g., in a cyclical or random manner). In specific embodiments, Y=1. In other embodiments $Y \leqq 2 < X/2$.

Figure 9B:
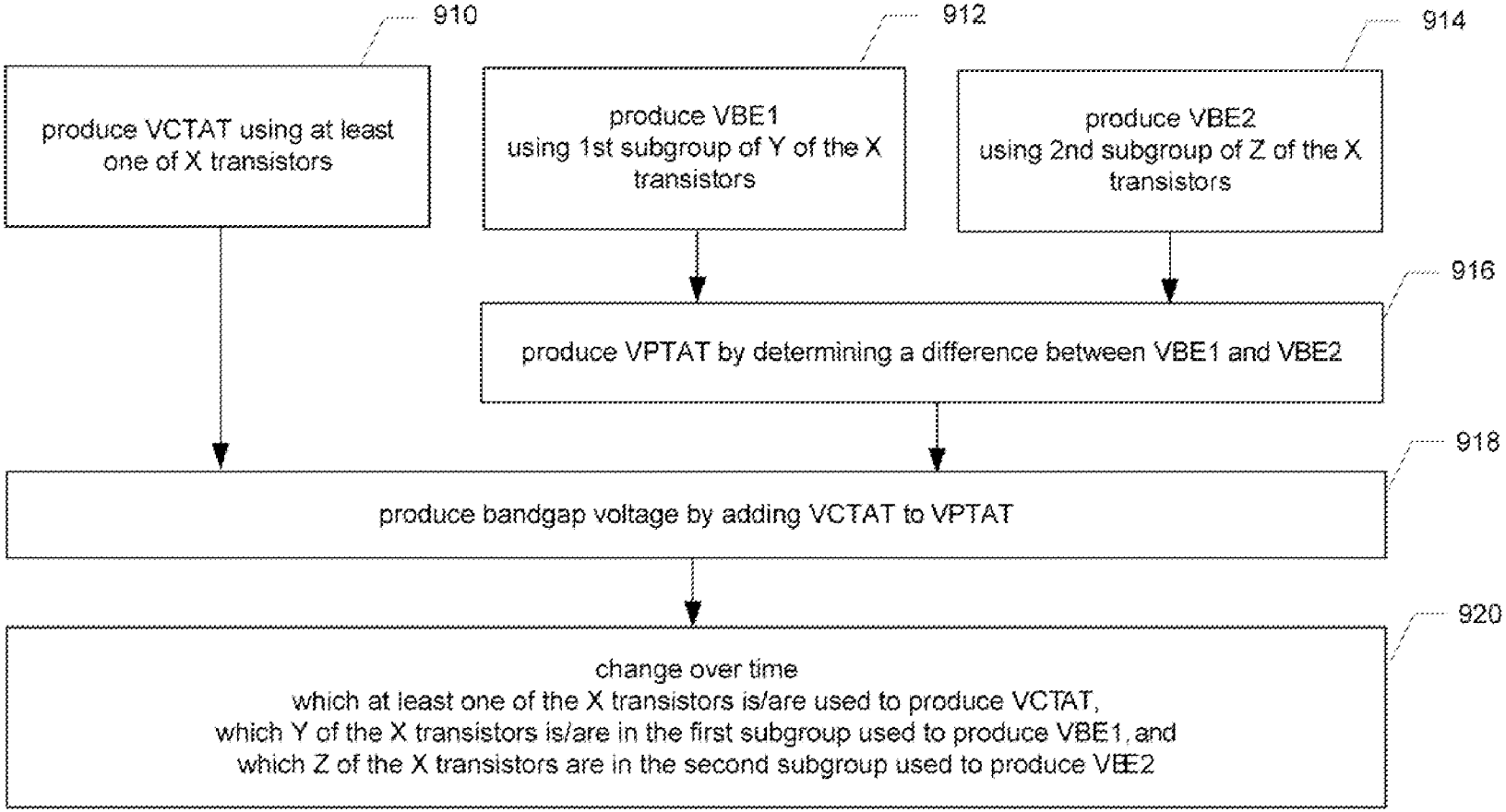
FIG. 9B is a high level flow diagram used to summarize various embodiments for producing a bandgap voltage.

FIG. 9B is a high level flow diagram that is used to summarize the above described techniques for producing a bandgap voltage using a group of X transistors. At step 910, a voltage complimentary to absolute temperature (VCTAT) is produced using at least one of the X transistors. At step 912, a first base-emitter voltage (VBE1) is produced using a first subgroup of Y of the X transistors, where $1 \leqq Y < X$. At step 914, a second base-emitter voltage (VBE2) is produced using a second subgroup of Z of the X transistors, where $Y < Z < X$. At step 916, a voltage proportional to absolute temperature (VPTAT) is produced by determining a difference between the first base-emitter voltage (VBE1) and the second base-emitter voltage (VBE2). At step 918, the bandgap voltage is produced by adding the VCTAT to the VPTAT to produce the bandgap voltage. As indicated at step 920, which Y of the X transistors is/are in the first subgroup that are used to produce the first base-emitter voltage (VBE1), and which Z of the X transistors are in the second subgroup that are used to produce the second base-emitter voltage (VBE2), are changed over time (e.g., in a cyclical or random manner). In specific embodiments, which at least one of the X transistors is/are used to produce the VCTAT, change over time (e.g., in a cyclical or random manner). In specific embodiments, Y=1. In other embodiments $Y \leqq 2 < X/2$.

Described above and shown in the corresponding figures are just a few examples of VPTAT and bandgap voltage reference circuits where there is selective controlling (including changing) of which transistors are used to produce a VPTAT and/or a VCTAT. However, one of ordinary skill in the art will appreciate that the features described above can be used with alternative VPTAT circuits and alternative bandgap voltage reference circuits. For one example, the selective controlling of which transistors are used to produce a VPTAT and/or a VCTAT can be used with the circuits shown and described in commonly invented and commonly assigned U.S. patent application Ser. No. 11/968,551, filed Jan. 2, 2008, and entitled "Bandgap Voltage Reference Circuits and Methods for Producing Bandgap Voltages", which is incorporated herein by reference.

Low-Glitch Preconditioning

In the circuits described above the transistors in the "1" and "CTAT" positions (which can also be referred to as the transistors in the "1" and "CTAT" branches) operate at N times the current as the transistors in the "N" position (which can also be referred to as the transistors in the "N" branch). Thus, when switches are used to connect or disconnect a transistor from the "N" branch, the current through that transistor will change by a factor of N. More specifically, if a transistor is switched from the "N" branch into either the "1" branch or the "CTAT" branch, the current through that transistor will increase by a factor of N. Conversely, if a transistor is switched from either the "1" branch or the "CTAT" branch into the "N" branch, the current through that transistor will decrease by a factor of N. When such switching occurs, a control loop of the circuit provides an impulse of current into the transistor to adjust its base charge accordingly. Such a control loop includes the amplifier 120, whose output voltage controls PMOS gates, which sets the current in the "N" and "1" branches, which sets the voltages at the non-inverting (+) and inverting (−) inputs of the amplifier 120, which sets the output voltage of the amplifier 120, etc. Thus, the feedback loop includes the "N" and "1" branches, but not the "CTAT" branch. To illustrate, imagine that a transistor operating at Iptat/N (voltage across this device: VBE-ΔVBE) is swapped into the "1" branch. This will lower the voltage at the inverting (−) input of the amplifier 120 by $\Delta VBE = Vt*\ln(N)$, but leave the non-inverting (+) input unchanged. The amplifier 120 amplifies this difference, which causes its output to go high. This causes current in the CTAT branch to dip low, which in turn causes a negative-going glitch in the output. However, this impulse of current may be mirrored into (or otherwise affect) all circuit branches, which can cause bandgap output glitches. Such glitches can be a limiting factor on system accuracy, because the area under the glitch is integrated into DC error by a low-pass filter (e.g., 404) at the system output. Embodiments of the present invention, described below, significantly reduce the glitches that are due to the above described switching of BJT transistors.

Figure 10A:
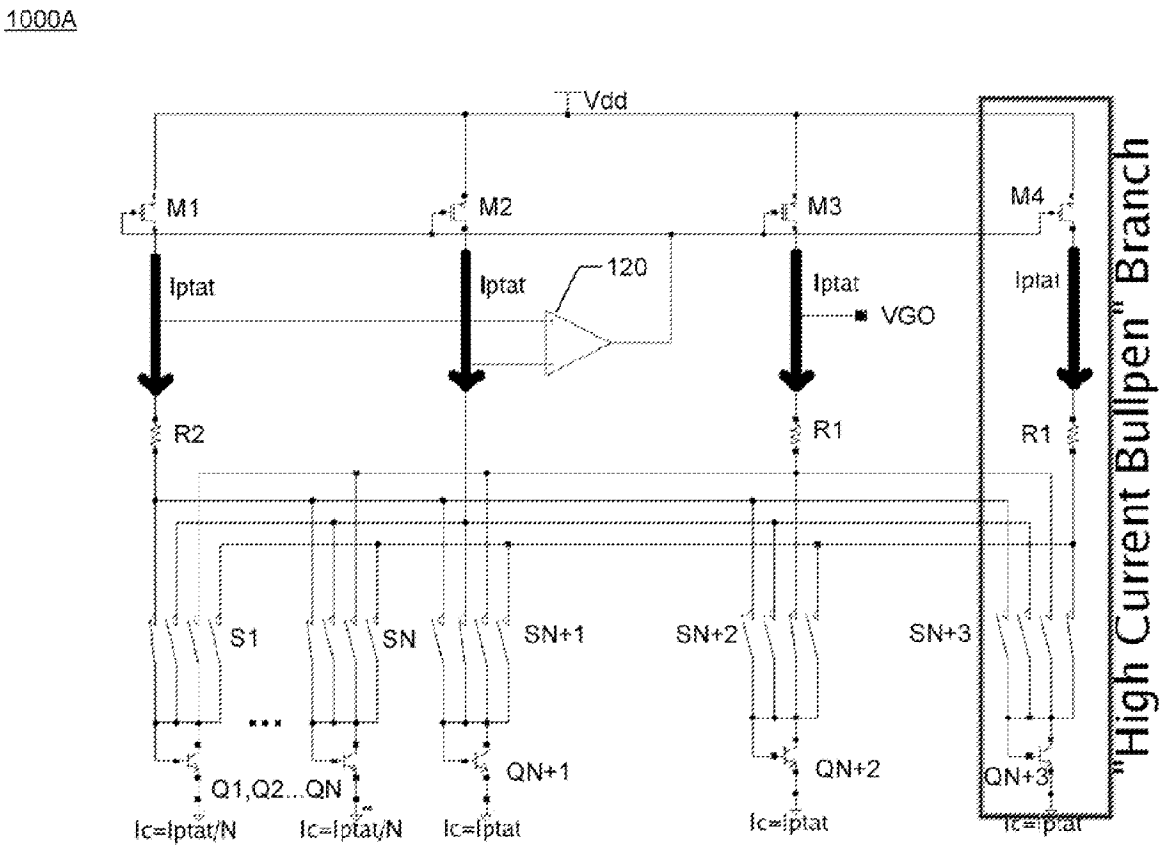
FIG. 10A illustrates a circuit, according to an embodiment of the present invention, that includes a "high current bullpen" branch that can be used to reduce glitches that occur when a transistor is switched to a branch that increases the current through the transistor.

FIG. 10A illustrates a circuit 1000A, according to an embodiment of the present invention, that can be used to reduce glitches that occur when a transistor is switched to a branch that increases the current through the transistor. In this embodiment, as a transistor is switching from the "N" branch to the "1" or "CTAT" branches, that transistor is first preconditioned to its new higher current in a branch outside the control loop, within the branch labeled "high current bullpen", but which can also be referred to as a low-to-high current preconditioning branch. The preconditioning current preferably simulates the current the transistor will receive in the "1" or "CTAT" branches. This can be accomplished, e.g., by generating the preconditioning current using the same current mirror used to produce the currents that are within the control loop. Beneficially, because the low-to-high current preconditioning branch is outside the control loop, the preconditioning branch does not influence the output of the circuit. Specifically, the action of preconditioning a transistor in this branch does not influence the bandgap output.

Figure 10B:
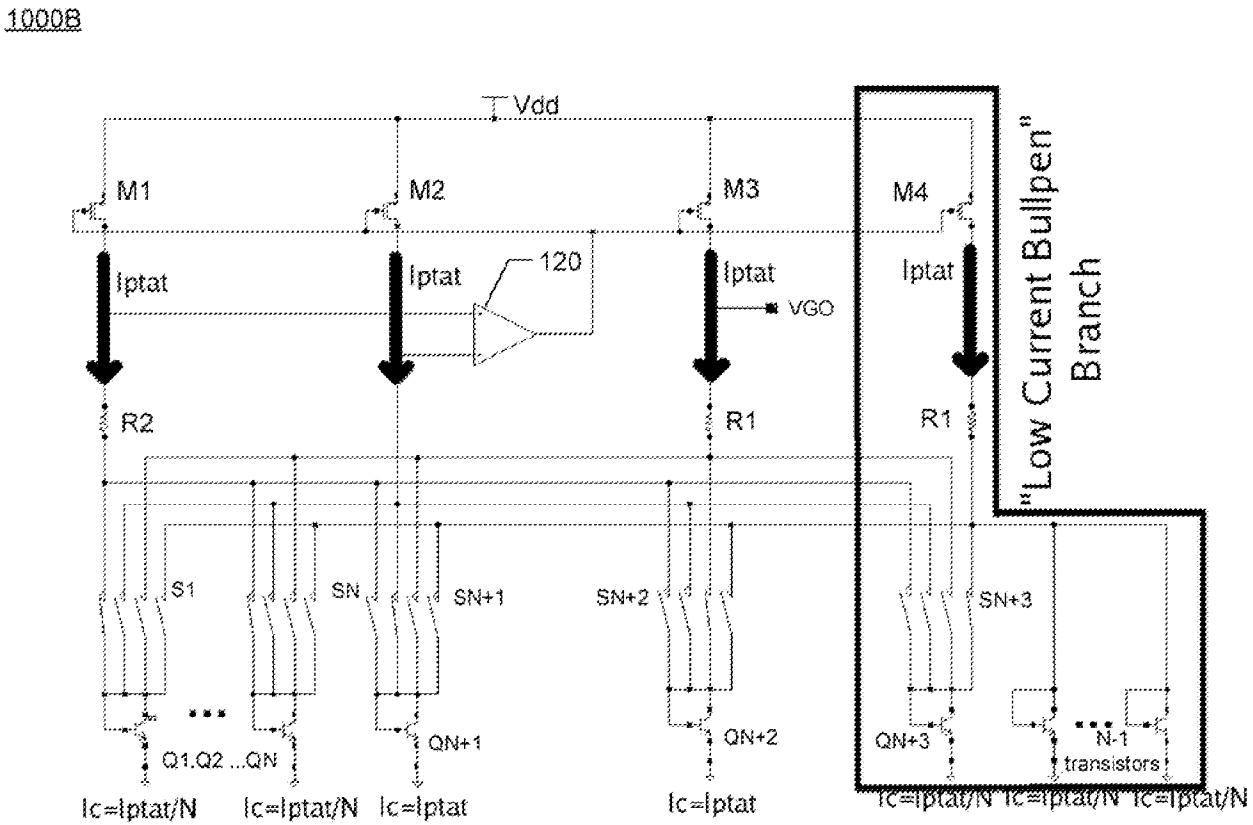
FIG. 10B illustrates a circuit, according to an embodiment of the present invention, that includes a "low current bullpen" branch can be used to reduce glitches that occur when a transistor is switched to a branch that reduces the current through the transistor.

FIG. 10B illustrates a circuit 1000B, according to an embodiment of the present invention, that can be used to reduce glitches that occur when a transistor is switched to a branch that reduces the current through the transistor. In this embodiment, as a transistor is switching from the "1" or "CTAT" branches to the "N" branch, that transistor is first preconditioned to its new lower current in a branch outside the control loop, within the branch labeled "low current bullpen", but which can also be referred to as a high-to-low current preconditioning branch. The preconditioning current preferably simulates the current the transistor will receive in the "N" branch. This can be accomplished, e.g., as in the "N" branch, by having the transistor being preconditioned as one among N identical transistors. Beneficially, because the high-to-low current preconditioning branch is outside the portions of the circuit used to generate VBE1, VBE2 and CTAT, the pre-conditioning branch does not influence the output of the circuit.

In FIG. 10B, only one transistor (i.e., transistor QN+3) is specifically shown as being switched in and out of the "low current bullpen" branch. In another embodiment, all the transistors in the "low current bullpen" branch (or at least a plurality of such transistors) are switched into and out of the "low current bullpen" branch, and thus, into and out of the other branches of the circuit.

Figure 10C:
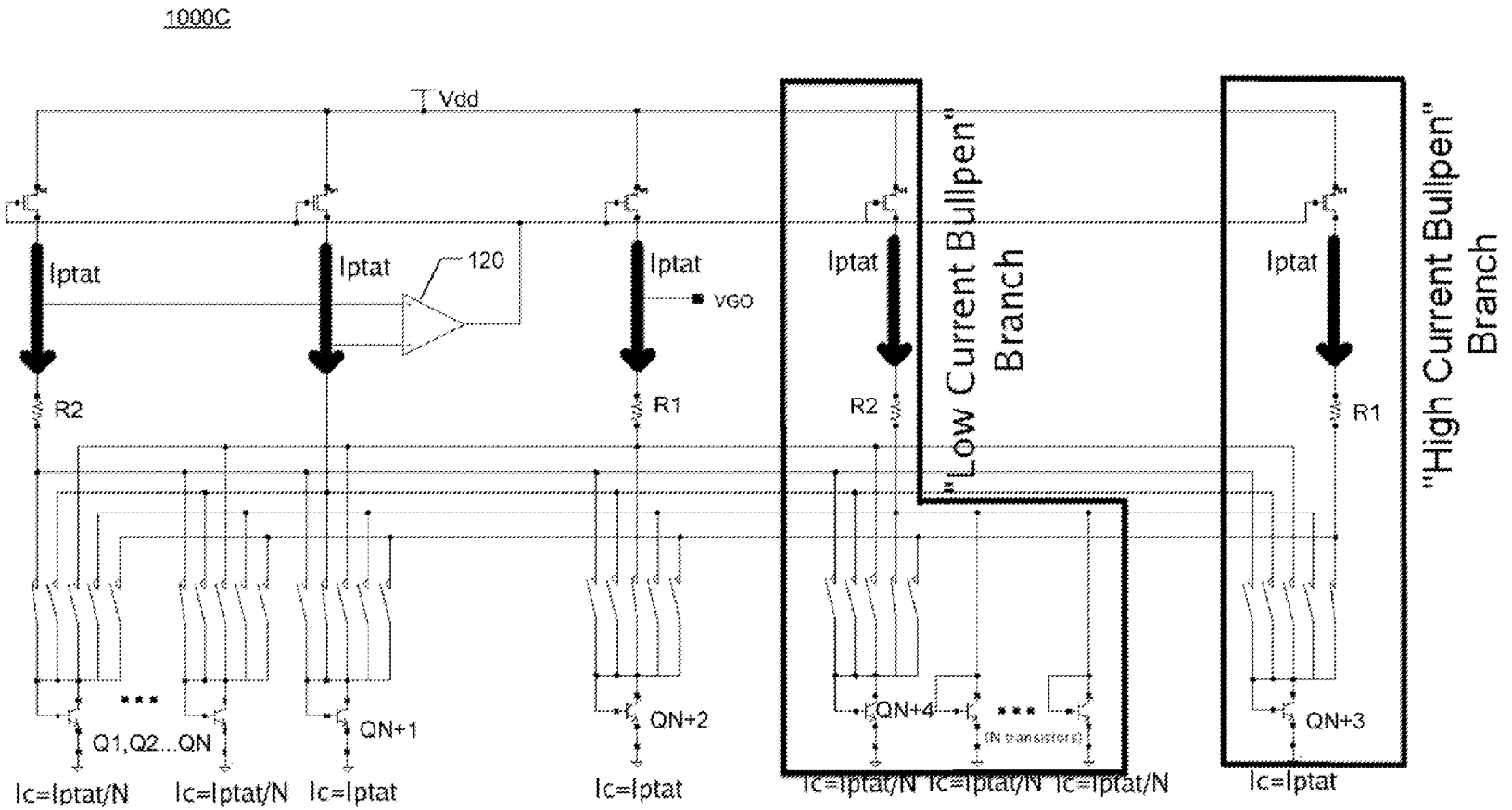
FIG. 10C illustrates a circuit, according to an embodiment of the present invention, that includes both a "low current bullpen" branch and a "high current bullpen" branch

In accordance with an embodiment, both a high-to-low current preconditioning branch and a low-to-high current preconditioning branch are both used in a circuit, so that preconditioning occurs both when transistors are switched to a higher current, as well as when transistors are switched to a lower current. In other words, a circuit 1000C can include both a "high current bullpen" and a "low current bullpen", as shown in FIG. 10C.

Figure 10D:
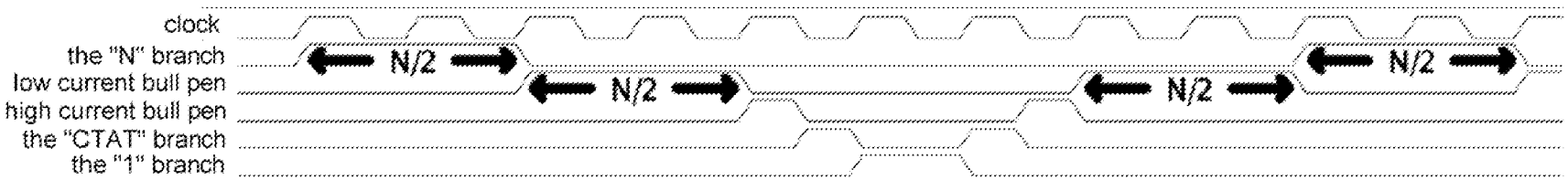
FIG. 10D is an exemplary timing diagram that can be used to control how each transistor of a circuit is switched into and out of the various branches of a circuit that includes both a "high current bullpen" branch and a "low current bullpen" branch, where N=4.

FIG. 10D is an exemplary timing diagram that can be used to control how each transistor of a circuit is switched into and out of the various branches of a circuit (e.g., 1000C in FIG. 10C) that includes both a "high current bullpen" branch and a "low current bullpen" branch. In FIG. 10D, a transistor starts in the "N" branch, is then switched into the "low current bullpen", then the "high current bullpen", then the "CTAT" branch, then the "1" branch, then the "CTAT" branch, then the "high current bullpen", then the "low current bullpen", and then the "N" branch, and so on. Alternative timing diagrams are also possible, and within the scope of the present invention. Note that when a transistor is switched from the "1" branch to the "CTAT" branch, or vice versa, that transistor need not go through one of the preconditioning bullpens, if the currents provided to the current paths of the transistors in the "1" branch and the "CTAT" branch are the same. However, a marginal improvement may be achieved if a transistor is always switched into a preconditioning branch between being switched from any one of the "1", "N" and "CTAT" branches to another one of the "1", "N" and "CTAT" branches.

In accordance with an embodiment, each transistor spends 1/(2N+3) of the time in each of the "1", "CTAT", and "High-Current Bullpen" branches, and N/(2N+3) of the time in each of the "N" and "Low-Current Bullpen" branches. In other embodiments, this is not the case.

In accordance with an embodiment, R1=9*R2. To decrease the variability of the bandgap output voltage across many individual integrated circuits, the R2/R1 ratio should itself have low variance. Since the resistor variance decreases with its die area, it is sensible to make R2 and R1 the same physical size. Otherwise, the variance of the smaller resistor would dominate, and the extra area used to implement the larger resistor would be wasted. One way to size R1 and R2 equally is to construct both from M identical resistors of value R. R1, which has the larger value, is formed from the M resistors in series (equivalent resistance: MR). R2 is formed from the M resistors in parallel (equivalent resistance: R/M). In this way, R1/R2=$M^2$. In a typical bandgap, R1/R2 is set equal to 23.5/ln(N), in order to exactly cancel the PTAT and CTAT temperature coefficients of the bandgap output voltage. By back-solving for N, it is evident that M=3 yields a satisfactory value (N~14). If M=2, N~356, which would result in an unreasonably large voltage reference die. If M=4, N~4, which is so small hat little statistical advantage is gained from rotating transistors among the branches.

In the embodiments described herein, the transistor(s) that is/are used to produce the first base-emitter voltage (VBE1) can also be referred to as being within the first base-emitter voltage branch, and the transistors that are used to produce the second base-emitter voltage (VBE2) can be referred to as being within the second base-emitter voltage branch. Similarly, the transistor(s) that is/are used to produce the VCTAT can be referred to as being within the CTAT branch. Further, when a transistor is within the "high current bullpen" or the "low current bullpen", the transistor can be referred to as being within a preconditioning branch.

Figure 11:
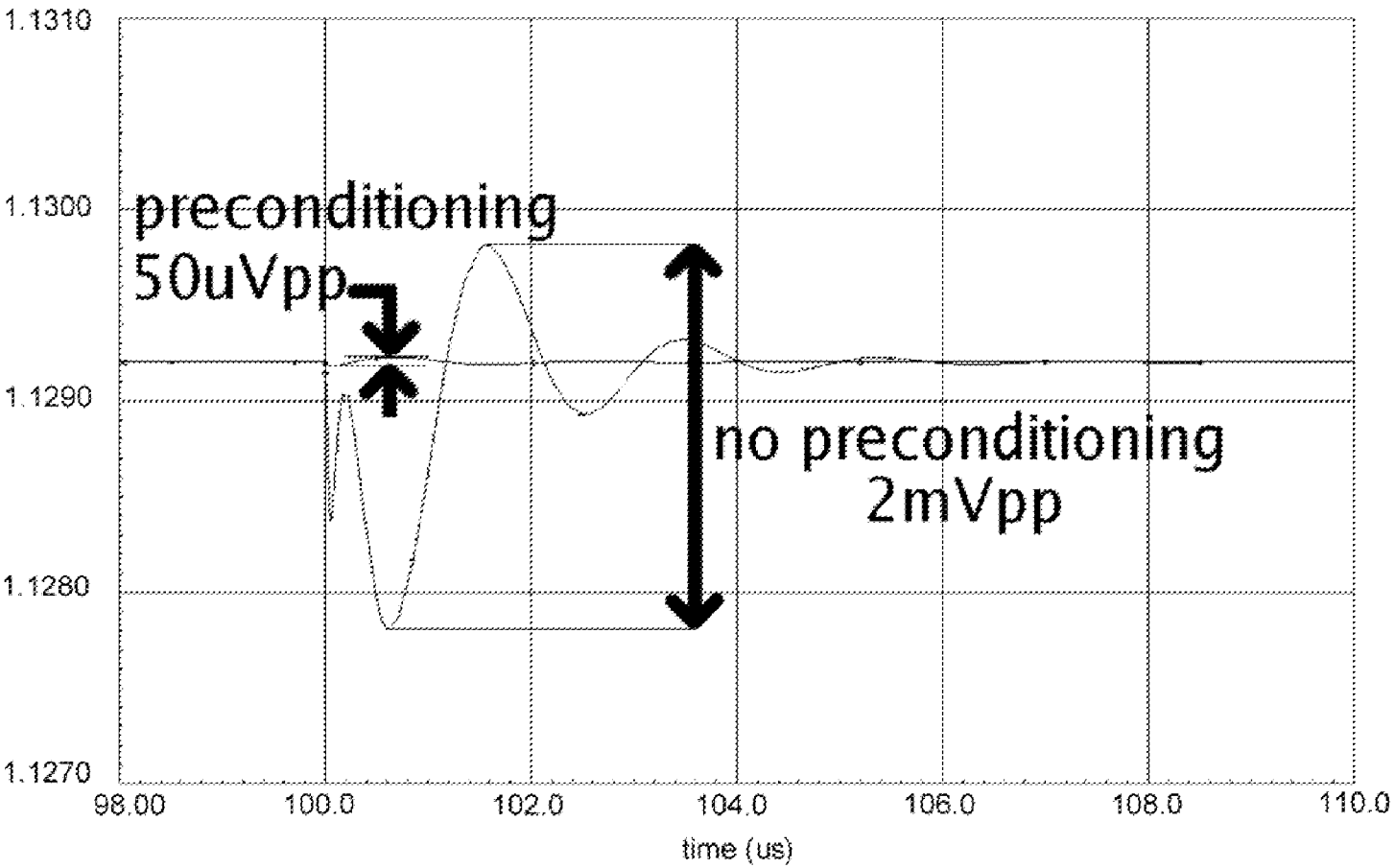
FIG. 11 illustrates how the embodiments described with reference to FIGS. 10A and 10B can be used to reduce glitch in the output of a bandgap voltage reference circuit.

FIG. 11 plots VGO for the circuit of FIG. 3 without preconditioning, and with the pre-conditioning of FIGS. 10A and 10B. More specifically, as can be appreciated from FIG. 11, the peak-to-peak glitch amplitude can be reduced by a factor of about 40 when both a high-to-low current preconditioning branch and a low-to-high current preconditioning branch are used.

Similar techniques can be performed on/for the resistors R2 and R1, in the embodiment of FIGS. 10A-10C (as well as the other embodiments), which may also suffer from low-frequency noise and accuracy problems. The idea is that it would also be beneficial for the resistors to be rotated, because they suffer from similar noise and drift problems as the BJTs. But rotating resistors presents the similar glitch problem as rotating transistors. Thus, to reduce such glitches, similar pre-conditioning of the resistors can be performed. This can be accomplished without burning extra current, by stacking resistors to be preconditioned on top of the BJTs in the existing "high current bullpen" and "low current bullpen" preconditioning branches.

The VGO output by a circuit including a high-to-low current preconditioning branch and/or a low-to-high current preconditioning branch can be filtered (e.g., using a filter 404) to produced a filtered VGO. Because of the significant glitch reduction, integrated DC error will be very small because glitches are low-amplitude and short compared to a typical switching speed (100 kHz). Further, such small glitches are easier to filter (e.g., using a filter 404) and require smaller capacitors as compared to when filtering larger glitches. Beneficially, with a significant improvement in glitch amplitude (e.g., the 40× improvement shown in FIG. 11), the capacitor of the filter used to reduce output glitch to desired levels could likely be integrated, saving board space and reducing cost. A high-to-low current preconditioning branch and/or a low-to-high current preconditioning branch can similarly be used to improve the performance of a circuit that outputs a VPTAT.

The bandgap voltage reference circuits of embodiments the present invention can be used in any circuit where there is a desire to produce a voltage reference that remains substantially constant over a range of temperatures. For example, in accordance with specific embodiments of the present invention, bandgap voltage reference circuits described herein can be used to produce a voltage regulator circuit. This can be accomplished, e.g., by buffering VGO and providing the buffered VGO to an amplifier that increases the VGO (e.g., ≈1.2V) to a desired level. Exemplary voltage regulator circuits are described below with reference to FIGS. 13 and 14.

12A is a high level flow diagram that is used to summarize the above described techniques for producing a VPTAT using current preconditioning to reduce glitches. At step 1202, a first base-emitter voltage (VBE1) is produced by providing a first amount of current to a current path of each transistor within a first circuit branch. At step 1204, a second base-emitter voltage (VBE2) is produced by providing a second amount of current to a current path of each transistor within a second circuit branch, where the second amount of current is less than the first amount of current. At step 1206, the VPTAT is produced based on VBE1 and VBE2, e.g., by determining a difference between the first base-emitter voltage (VBE1) and the second base-emitter voltage (VBE2). As indicated at step 1208, over time, which transistors are in the first circuit branch and the second circuit branch are changed. As explained above, this feature can be used to reduce 1/f noise. As indicated at step 1212, a transistor is preconditioned with a current substantially equal to the second amount of current, after the transistor is switched out of the first circuit branch, but before the said transistor is switched into the second circuit branch. As indicated at step 1214, a transistor is preconditioned with a current substantially equal to the first amount of current, after the transistor is switched out of the second circuit branch, but before the transistor is switched into the first circuit branch. As explained above, such preconditioning reduces glitches in VPTAT.

Figure 12A:
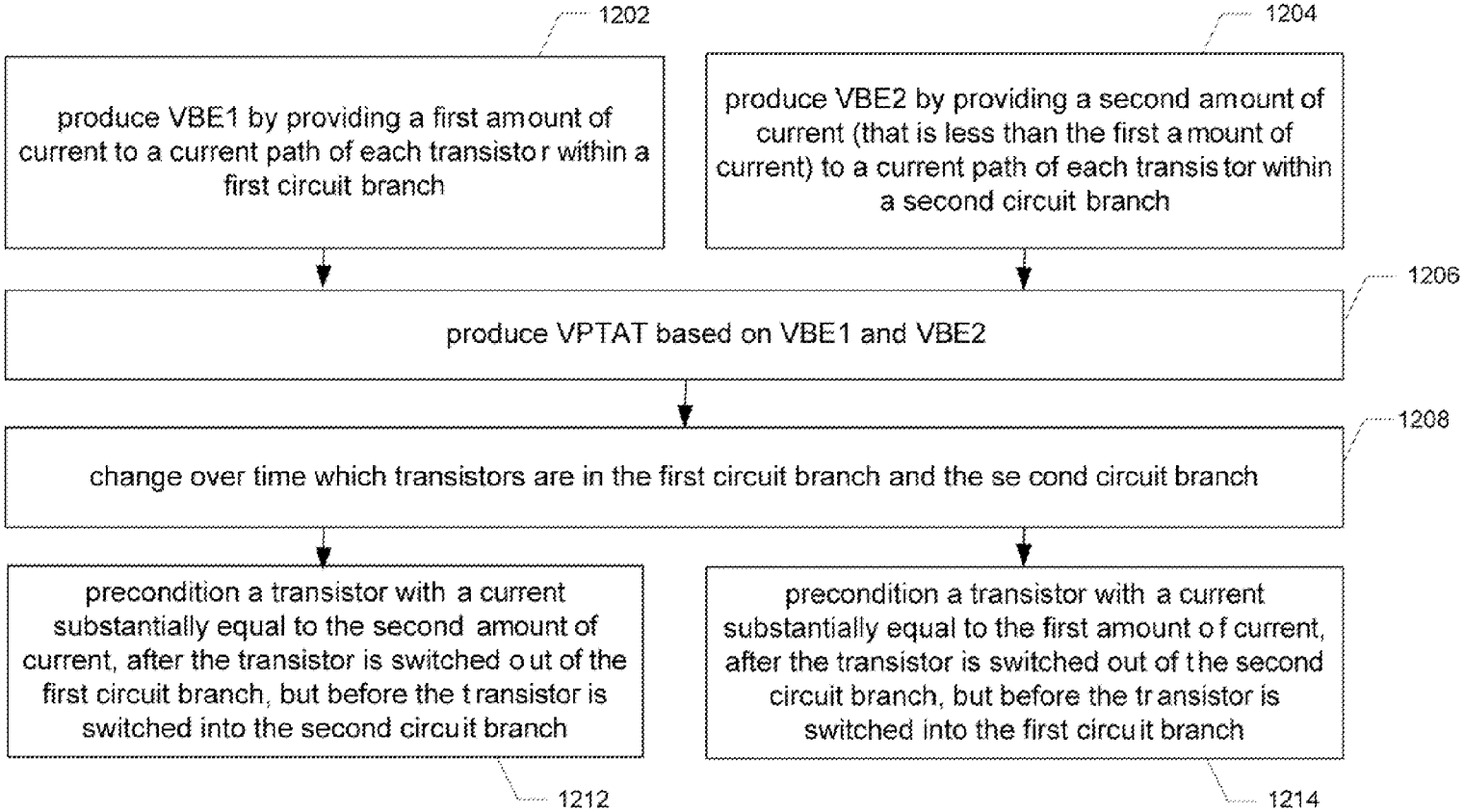
FIG. 12A is a high level flow diagram used to summarize further embodiments for producing a VPTAT.
Figure 12B:
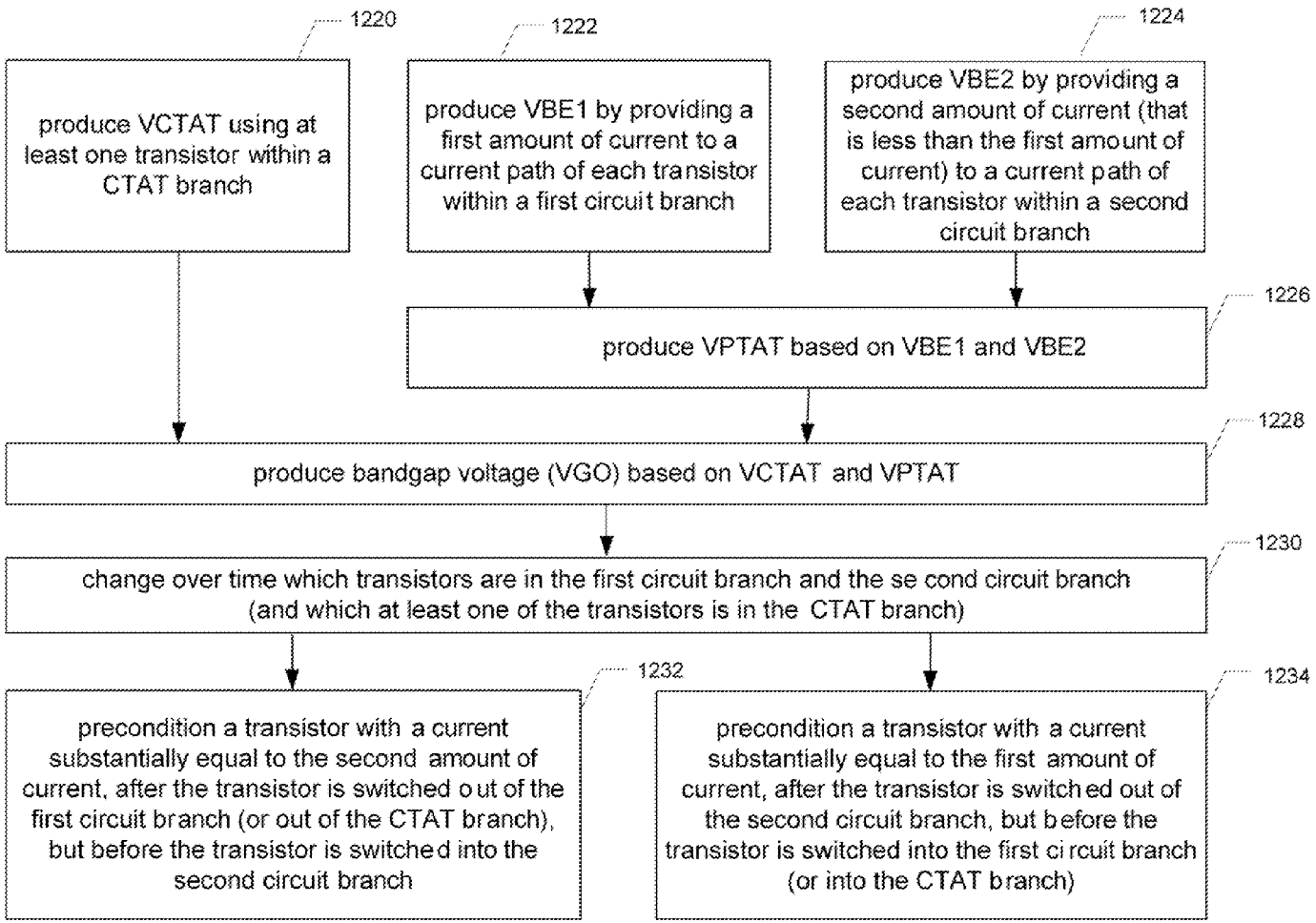
FIG. 12B is a high level flow diagram used to summarize further embodiments for producing a bandgap voltage.

FIG. 12B is a high level flow diagram that is used to summarize the above described techniques for producing a bandgap voltage using current preconditioning to reduce glitches in a bandgap voltage output (VGO). At step 1220, a voltage complimentary to absolute temperature (VCTAT) is produced using at least one of transistor within a CTAT branch. At step 1222, a first base-emitter voltage (VBE1) is produced by providing a first amount of current to a current path of each transistor within a first circuit branch. At step 1224, a second base-emitter voltage (VBE2) is produced by providing a second amount of current to a current path of each transistor within a second circuit branch. At step 1226, a voltage proportional to absolute temperature (VPTAT) is determined based on the first base-emitter voltage (VBE1) and the second base-emitter voltage (VBE2), e.g., by determining a difference between VBE1 and VBE2. As indicated at step 1228, the bandgap voltage can be determined based on VCTAT and VPTAT, e.g., by adding the VCTAT to the VPTAT. As indicated at step 1230, over time which transistors are in the first circuit branch and the second circuit branch are changed. Additionally, at step 1230, which at least one of the transistors is in the CTAT branch can also be changed. As indicated at step 1232, a transistor is preconditioned with a current substantially equal to the second amount of current, after the transistor is switched out of the first circuit branch (or out of the CTAT branch), but before the transistor is switched into the second circuit branch. As indicated at step 1234, a transistor is preconditioned with a current substantially equal to the first amount of current, after the transistor is switched out of the second circuit branch, but before the transistor is switched into the first circuit branch (or into the CTAT branch).

Figure 13:
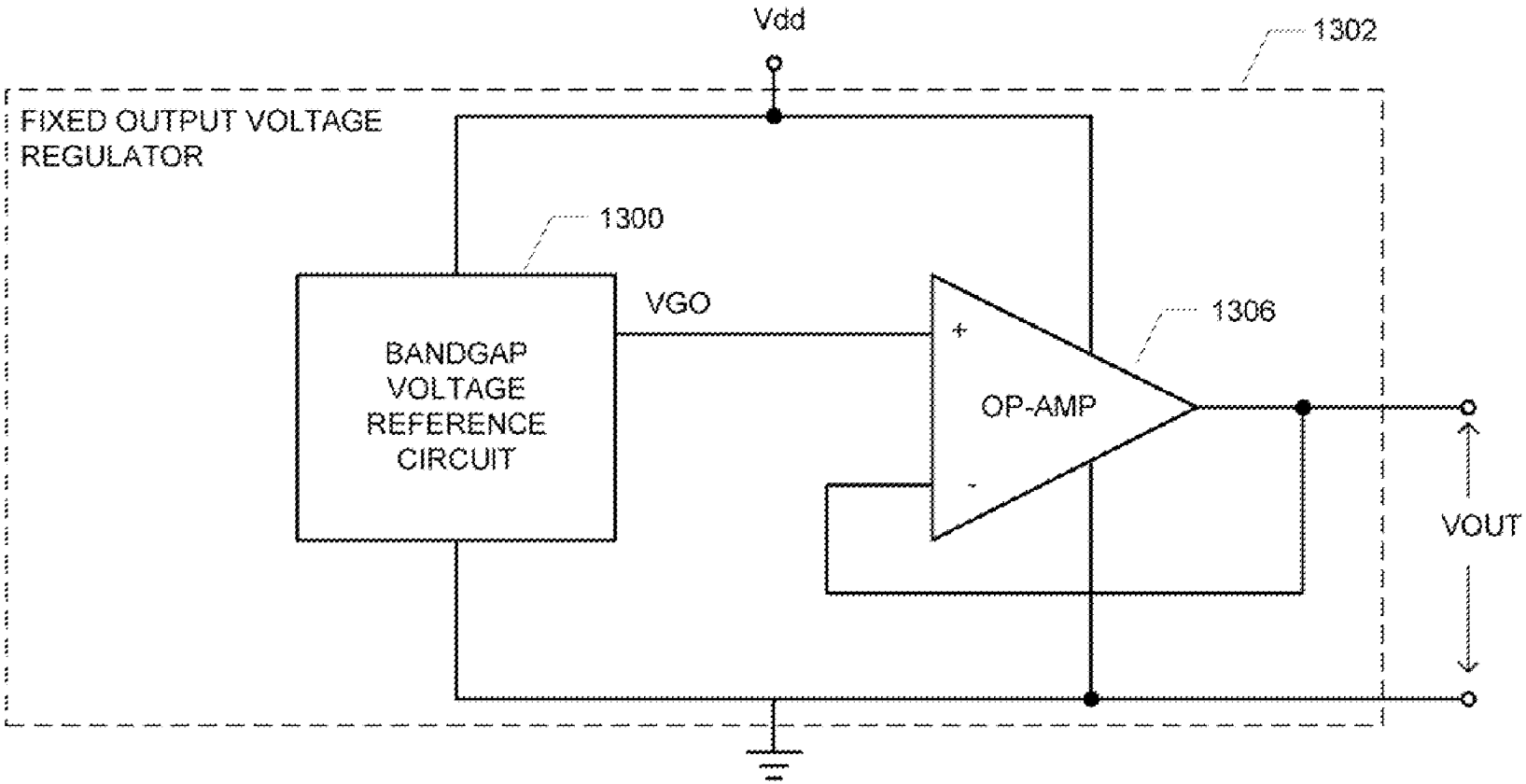
FIG. 13 is a high level block diagram of an exemplary fixed output linear voltage regulator that includes a bandgap voltage reference circuit of an embodiment of the present invention.

FIG. 13 is a block diagram of an exemplary fixed output linear voltage regulator 1302 that includes a bandgap voltage reference circuit 1300 that changes which transistors are in the "1" and the "N" branches (and preferably also the "CTAT" branch), and includes a high-to-low current preconditioning branch and/or a low-to-high current preconditioning branch (and preferably both). The bandgap voltage reference circuit 1300 produces a low glitch bandgap voltage output (VGO), which is provided to an input (e.g., a non-inverting input) of an operational-amplifier 1306, which is connected as a buffer. The other input (e.g., the inverting input) of the operation-amplifier 1306 receives an amplifier output voltage (VOUT) as a feedback signal. The output voltage (VOUT), through use of the feedback, remains substantially fixed, +/− a tolerance (e.g., +/−1%).

Figure 14:
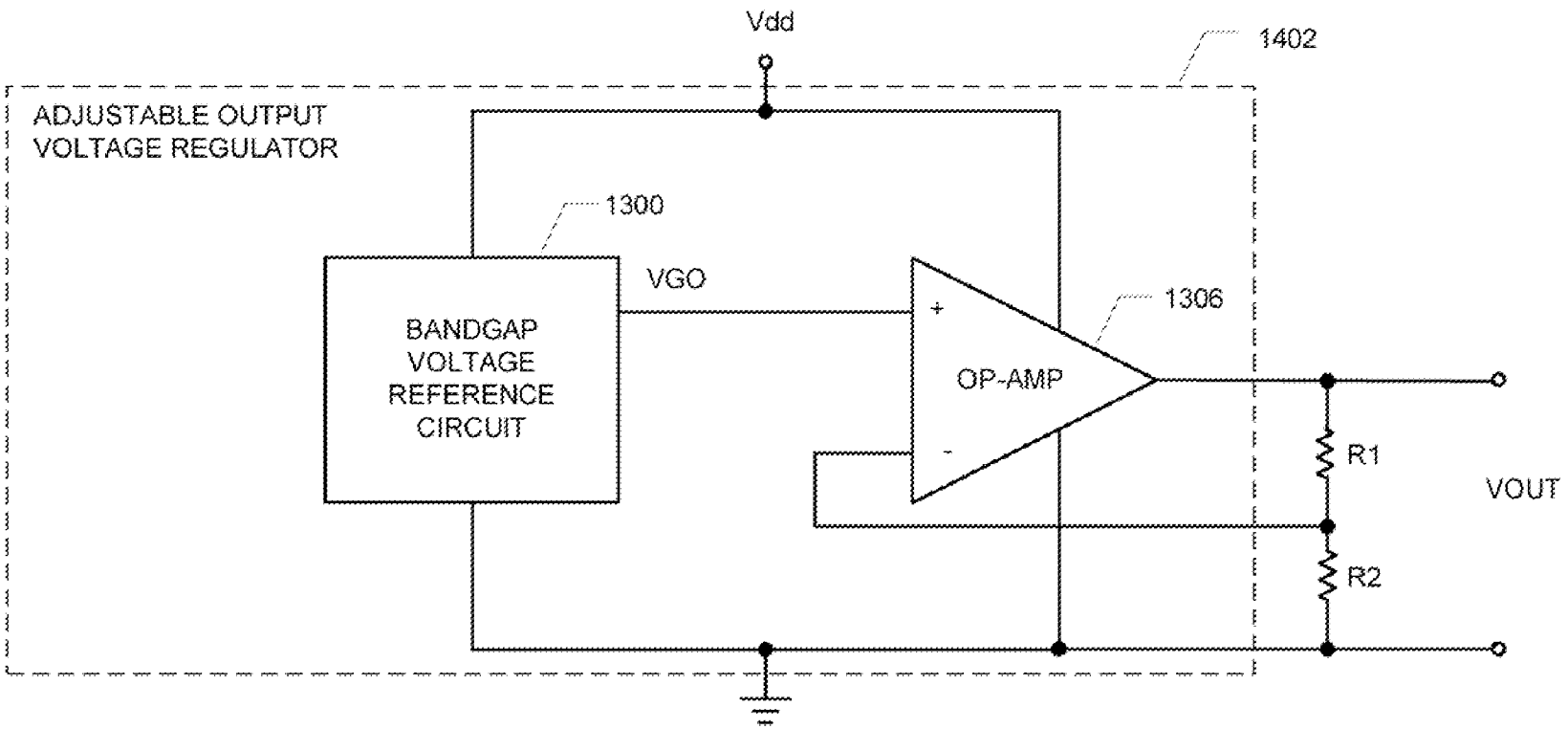
FIG. 14 is a high level block diagram of an exemplary adjustable output linear voltage regulator that includes a bandgap voltage reference circuit of an embodiment of the present invention.

FIG. 14 is a block diagram of an exemplary adjustable output linear voltage regulator 1402 that includes a bandgap voltage reference circuit 1300 that changes which transistors are in the "1" and the "N" branches (and preferably also the "CTAT" branch), and includes a high-to-low current preconditioning branch and/or a low-to-high current preconditioning branch (and preferably both). As can be appreciated from FIG. 14, VOUT≈VGO*(1+R1/R2). Thus, by selecting the appropriate values for resistors R1 and R2, the desired VOUT can be selected. The resistors R1 and R2 can be within the regulator, or external to the regulator. One or both resistors can be programmable or otherwise adjustable.

Figure 15:
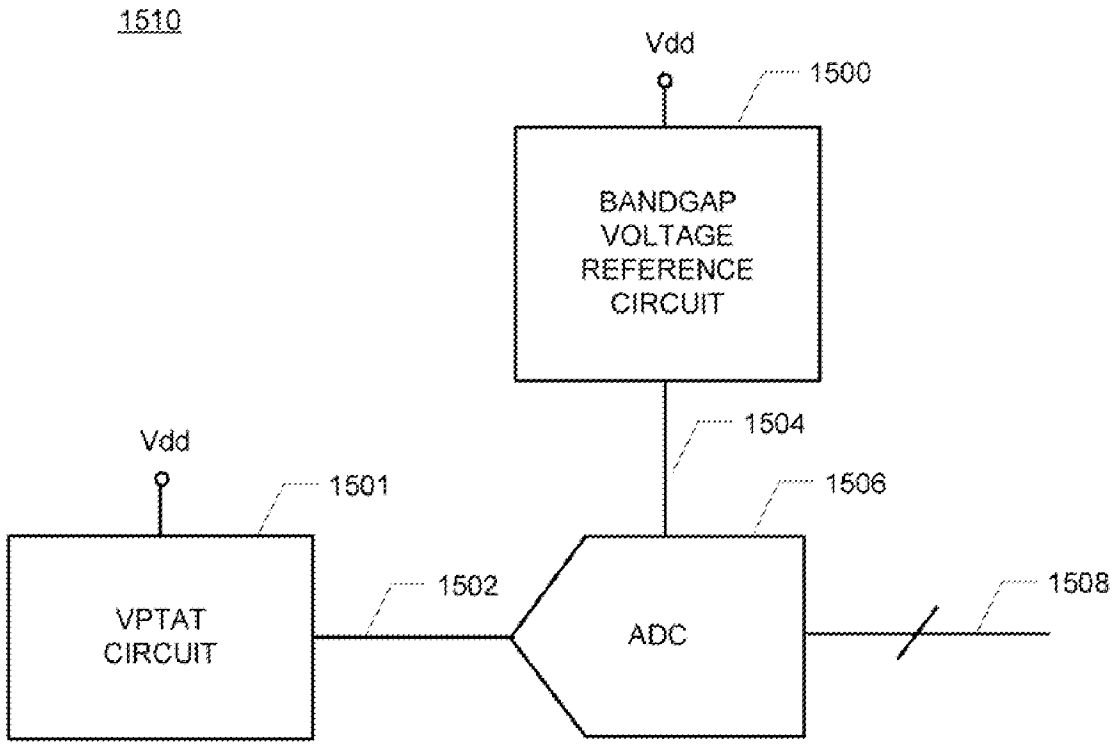
FIG. 15 is a high level block diagram of an exemplary temperature sensor according to an embodiment of the present invention.

The bandgap voltage reference circuits and/or the VPTAT circuits can also be used to provide a temperature sensor. FIG. 15 is an example of such a temperature sensor 1510. A bandgap voltage reference circuit 1300 that changes which transistors are in the "1" and the "N" branches (and preferably also the "CTAT" branch) can provide a substantially constant bandgap voltage output (VGO) signal 1504 to a reference voltage input of an analog-to-digital converter (ADC) 1506. A VPTAT circuit 1501 that changes which transistors are in the "1" and the "N" branches can provide an analog VPTAT signal 1502 to the signal input of the ADC 1506. The bandgap voltage reference circuit 1300 and the VPTAT circuit 1501 can each include a high-to-low current preconditioning branch and/or a low-to-high current preconditioning branch (and preferably both). In such an embodiment, the output of the ADC 1506 is a digital signal 1508 indicative of temperature, since the input to the ADC 1506 is proportional to temperature. Alternative, a same circuit of an embodiment of the present invention described above can be used to produce both the VGO and the VPTAT, and the VGO can be used to provide a substantially constant reference voltage to the ADC 1506, and the VPTAT (tapped off the circuit) can be provided to the signal input of the ADC 1506. Again, the output of the ADC 1506 is a digital signal 1508 indicative of temperature, since the input to the ADC 1506 is proportional to temperature.

The foregoing description is of the preferred embodiments of the present invention. These embodiments have been provided for the purposes of illustration and description, but are not intended to be exhaustive or to limit the invention to the precise forms disclosed. Many modifications and variations will be apparent to a practitioner skilled in the art. Embodiments were chosen and described in order to best describe the principles of the invention and its practical application, thereby enabling others skilled in the art to understand the invention. Slight modifications and variations are believed to be within the spirit and scope of the present invention. It is intended that the scope of the invention be defined by the following claims and their equivalents.

What is claimed:

1. A circuit to generate a voltage proportional to absolute temperature (VPTAT), comprising:

a group of X transistors, each of which includes a base and a current path between a collector and an emitter;

a plurality of switches configured to selectively change how at least some of the X transistors are connected within the circuit;

a first base-emitter voltage branch configured to provide a first amount of current to the current path of each transistor within the first base-emitter voltage branch to produce a first base-emitter voltage (VBE1);

a second base-emitter voltage branch configured to provide a second amount of current to the current path of each transistor within the second base-emitter voltage branch to produce a second base-emitter voltage (VBE2), where the second amount of current is less than the first amount of current;

a first current preconditioning branch configured to provide a current substantially equal to the first amount of current to each transistor within the first current preconditioning branch; and a second current preconditioning branch configured to provide a current substantially equal to the second amount of current to each transistor within the second current preconditioning branch;

wherein the VPTAT is produced based on the first base-emitter voltage (VBE1) and the second base-emitter voltage (VBE2), which are produced, respectively, by the first base-emitter voltage branch and the second base-emitter voltage branch;

wherein the transistors within the first and second preconditioning branches are not used to produce VBE1 and VBE2; and wherein the switches are used to selectively change over time which of the X transistors are in the first base-emitter voltage branch, the second base-emitter voltage branch, the first current preconditioning branch, and the second current preconditioning branch.

2. The circuit of claim 1, wherein:

after a said transistor is within the first base-emitter voltage branch, but before the switches are used to cause the said transistor to be within the second base-emitter voltage branch, the switches cause the said transistor to be within the second current preconditioning branch; and after a said transistor is within the second base-emitter voltage branch, but before the switches are used to cause the said transistor to be within the first base-emitter voltage branch, the switches cause the said transistor to be within the first current preconditioning branch.

3. The circuit of claim 2, further comprising:

a controller configured to control the switches to thereby control which of the X transistors are in the first base-emitter voltage branch, the second base-emitter voltage branch, the first current preconditioning branch, and the second current preconditioning branch.

4. A method for generating a voltage proportional to absolute temperature (VPTAT), comprising:

producing a first base-emitter voltage (VBE1) by providing a first amount of current to a first circuit branch;

producing a second base-emitter voltage (VBE2) by providing a second amount of current to a second circuit branch, where the second amount of current is less than the first amount of current;

producing the VPTAT based on the first base-emitter voltage (VBE1) and the second base-emitter voltage (VBE2);

changing over time which transistors are in the first circuit branch and the second circuit branch;

preconditioning a said transistor with a current substantially equal to the second amount of current, after the said transistor is switched out of the first circuit branch, but before the said transistor is switched into the second circuit branch; and preconditioning a said transistor with a current substantially equal to the first amount of current, after the said transistor is switched out of the second circuit branch, but before the said transistor is switched into the first circuit branch.

5. A bandgap voltage reference circuit, comprising:

a group of X transistors, each of which includes a base and a current path between a collector and an emitter;

a plurality of switches configured to selectively change how at least some of the X transistors are connected within the circuit;

a first circuit portion that generates a voltage complimentary to absolute temperature (VCTAT) using at least one of the X transistors; and a second circuit portion that generates a voltage proportional to absolute temperature (VPTAT) that is added to the VCTAT to produce a bandgap voltage output (VGO), the second circuit portion comprising:

a first base-emitter voltage branch configured to provide a first amount of current to the current path of each transistor within the first base-emitter voltage branch to produce a first base-emitter voltage (VBE1); and a second base-emitter voltage branch configured to provide a second amount of current to the current path of each transistor within the second base-emitter voltage branch to produce a second base-emitter voltage (VBE2), where the second amount of current is less than the first amount of current;

wherein the VPTAT is produced based on the first base-emitter voltage (VBE1) and the second base-emitter voltage (VBE2);

a first current preconditioning branch configured to provide a current substantially equal to the first amount of current to each transistor within the first current preconditioning branch; and a second current preconditioning branch configured to provide a current substantially equal to the second amount of current to each transistor within the second current preconditioning branch;

wherein the switches are used to selectively change over time which of the X transistors are in the first base-emitter voltage branch, the second base-emitter voltage branch, the first current preconditioning branch, and the second current preconditioning branch.

6. The circuit of claim 5, wherein:

after being within the first base-emitter voltage branch, but before being switched to be within the second base-emitter voltage branch, a said transistor is switched to be within the second current preconditioning branch; and after being within the second base-emitter voltage branch, but before being switched to be within the first base-emitter voltage branch, a said transistor is switched to be within the first current preconditioning branch.

7. The circuit of claim 6, further:

a controller configured to control the switches to thereby control which of the X transistors are in the first base-emitter voltage branch, the second base-emitter voltage branch, the first current preconditioning branch, and the second current preconditioning branch.

8. The circuit of claim 5, wherein:

each of the at least one of the X transistors, within the first circuit portion that generates the VCTAT, is provided with the first amount of current; and the switches are also used to change over time which of the X transistors are within the first circuit portion.

9. The circuit of claim 8, wherein:

after being within the first base-emitter voltage branch, but before being switched to be within the second base-emitter voltage branch, a said transistor is switched to be within the second current preconditioning branch;

after being within the second base-emitter voltage branch, but before being switched to be within the first base-emitter voltage branch, a said transistor is switched to be within the first current preconditioning branch;

after being within the first circuit portion that generates the VCTAT, but before being switched to be within the second base-emitter voltage branch, a said transistor is switched to be within the second current preconditioning branch; and after being within the second base-emitter voltage branch, but before being switched to be within the first circuit portion that generates the VCTAT, a said transistor is switched to be within the first current preconditioning branch.

10. The circuit of claim 9, further comprising:

a controller configured to control the switches to thereby control which of the X transistors are in the first circuit portion, first base-emitter voltage branch, the second base-emitter voltage branch, the first current preconditioning branch, and the second current preconditioning branch.

11. A method for producing a bandgap voltage, comprising:

producing a first base-emitter voltage (VBE1) by providing a first amount of current to a first circuit branch;

producing a second base-emitter voltage (VBE2) by providing a second amount of current to a second circuit branch;

producing a voltage complimentary to absolute temperature (VCTAT) using a CTAT branch;

producing a voltage proportional to absolute temperature (VPTAT) based on the first base-emitter voltage (VBE1) and the second base-emitter voltage (VBE2); and producing the bandgap voltage based on the VCTAT and the VPTAT;

changing over time which transistors are in the first circuit branch and the second circuit branch;

preconditioning a said transistor with a current substantially equal to the second amount of current, after the said transistor is switched out of the first circuit branch, but before the said transistor is switched into the second circuit branch; and preconditioning a said transistor with a current substantially equal to the first amount of current, after the said transistor is switched out of the second circuit branch, but before the said transistor is switched into the first circuit branch.

12. The method of claim 11, wherein said changing also includes changing over time which at least one transistor is in the CTAT branch, and further comprising:

preconditioning a said transistor with a current substantially equal to the second amount of current, after the said transistor is switched out of the CTAT branch, but before the said transistor is switched into the second circuit branch; and preconditioning a said transistor with a current substantially equal to the first amount of current, after the said transistor is switched out of the second circuit branch, but before the said transistor is switched into the CTAT branch.

13. A voltage regulator, comprising:

a bandgap voltage reference circuit to produce a bandgap voltage output (VGO); and an operation amplifier including a non-inverting (+) input that receives the bandgap voltage output (VGO), an inverting (−) input, and an output that produces the voltage output (VOUT) of the voltage regulator;

wherein the bandgap voltage reference circuit includes a group of X transistors, each of which includes a base and a current path between a collector and an emitter;

a plurality of switches configured to selectively change how at least some of the X transistors are connected within the circuit;

a first circuit portion that generates a voltage complimentary to absolute temperature (VCTAT) using at least one of the X transistors; and a second circuit portion that generates a voltage proportional to absolute temperature (VPTAT) that is added to the VCTAT to produce a bandgap voltage output (VGO), the second circuit portion comprising:

a first base-emitter voltage branch configured to provide a first amount of current to the current path of each transistor within the first base-emitter voltage branch to produce a first base-emitter voltage (VBE1); and a second base-emitter voltage branch configured to provide a second amount of current to the current path of each transistor within the second base-emitter voltage branch to produce a second base-emitter voltage (VBE2), where the second amount of current is less than the first amount of current;

wherein the VPTAT is produced based on the first base-emitter voltage (VBE1) and the second base-emitter voltage (VBE2);

a first current preconditioning branch configured to provide a current substantially equal to the first amount of current to each transistor within the first current preconditioning branch; and a second current preconditioning branch configured to provide a current substantially equal to the second amount of current to each transistor within the second current preconditioning branch;

wherein the switches are used to selectively change over time which of the X transistors are in the first base-emitter voltage branch, the second base-emitter voltage branch, the first current preconditioning branch, and the second current preconditioning branch.

14. The voltage regulator of claim 13, wherein:

after being within the first base-emitter voltage branch, but before being switched to be within the second base-emitter voltage branch, a said transistor is switched to be within the second current preconditioning branch; and after being within the second base-emitter voltage branch, but before being switched to be within the first base-emitter voltage branch, a said transistor is switched to be within the first current preconditioning branch.

15. The voltage regulator of claim 13, wherein:

each of the at least one of the X transistors, within the first circuit portion that generates the VCTAT, is provided with the first amount of current; and the switches are also used to change over time which of the X transistors are within the first circuit portion.

16. The voltage regulator of claim 15, wherein:

after being within the first base-emitter voltage branch, but before being switched to be within the second base-emitter voltage branch, a said transistor is switched to be within the second current preconditioning branch;

after being within the second base-emitter voltage branch, but before being switched to be within the first base-emitter voltage branch, a said transistor is switched to be within the first current preconditioning branch;

after being within the first circuit portion that generates the VCTAT, but before being switched to be within the second base-emitter voltage branch, a said transistor is switched to be within the second current preconditioning branch; and after being within the second base-emitter voltage branch, but before being switched to be within the first circuit portion that generates the VCTAT, a said transistor is switched to be within the first current preconditioning branch.

17. The voltage regulator of claim 13, wherein the inverting (−) input of the operational amplifier is connected to the output of the operation amplifier.

18. The voltage regulator of claim 17, wherein the voltage regulator comprises a fixed output linear voltage regulator.

19. The voltage regulator of claim 13, further comprising:

a resistor divider to produce a further voltage in dependence on the voltage output (VOUT) of the voltage regulator;

wherein the inverting (−) input of the operational amplifier receives the further voltage produced by the resistor divider.

20. The voltage regulator of claim 19, wherein the voltage regulator comprises an adjustable output linear voltage regulator.

* * * * *